US007874663B2

(12) United States Patent
Makuta et al.

(10) Patent No.: US 7,874,663 B2
(45) Date of Patent: Jan. 25, 2011

(54) INKJET RECORDING METHOD AND INKJET RECORDING APPARATUS

(75) Inventors: Toshiyuki Makuta, Kanagawa (JP); Yusuke Nakazawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 598 days.

(21) Appl. No.: 11/864,970

(22) Filed: Sep. 29, 2007

(65) Prior Publication Data

US 2008/0079796 A1 Apr. 3, 2008

(30) Foreign Application Priority Data

Sep. 29, 2006 (JP) ..... 2006-269413
Apr. 12, 2007 (JP) ..... 2007-104686

(51) Int. Cl.
*B41J 2/01* (2006.01)

(52) U.S. Cl. ..... 347/101

(58) Field of Classification Search ..... 347/100–106
See application file for complete search history.

(56) References Cited

U.S. PATENT DOCUMENTS

| | | | | |
|---|---|---|---|---|
| 5,988,807 | A * | 11/1999 | Bernard et al. | 347/100 |
| 7,517,399 | B2 * | 4/2009 | Sato et al. | 106/31.58 |
| 7,537,652 | B2 * | 5/2009 | Koganehira et al. | 106/31.58 |
| 2003/0083396 | A1 * | 5/2003 | Ylitalo et al. | 522/74 |
| 2004/0091642 | A1 * | 5/2004 | Murakami et al. | 428/1.31 |
| 2006/0258774 | A1 * | 11/2006 | Kim et al. | 523/160 |

FOREIGN PATENT DOCUMENTS

| | | | |
|---|---|---|---|
| EP | 1 652 686 | A1 | 5/2006 |
| EP | 1 870 247 | A1 | 12/2007 |
| JP | 63-060783 | A | 3/1988 |
| JP | 08-174997 | A | 7/1996 |
| JP | 2003-145745 | A | 5/2003 |
| JP | 2004-042525 | A | 2/2004 |
| JP | 2004-042548 | A | 2/2004 |
| JP | 2004-276322 | A | 10/2004 |
| JP | 2005-096254 | A | 4/2005 |
| WO | WO 2006/046061 | A1 | 5/2006 |

OTHER PUBLICATIONS

EP Communication, dated Dec. 2, 2010, issued in corresponding EP Application No. 07017352.1, 7 pages.

* cited by examiner

*Primary Examiner*—Charlie Peng
(74) *Attorney, Agent, or Firm*—Sughrue Mion, PLLC

(57) ABSTRACT

The present invention provides: an inkjet recording method comprising: applying an undercoating liquid on a recording medium, the undercoating liquid containing at least one surfactant in an amount of from 0.001% to the critical micelle concentration, the surfactant achieving a surface tension of 25 mN/m or smaller when dissolved in 1,6-hexanediol diacrylate at a critical micelle concentration; semi-curing the applied undercoating liquid; and recording an image by ejecting an ink onto the semi-cured undercoating liquid, the ink being curable by irradiation with an actinic ray; and an inkjet recording apparatus.

17 Claims, 9 Drawing Sheets

INKJET RECORDING METHOD AND INKJET RECORDING APPARATUS

CROSS-REFERENCE TO RELATED APPLICATION

This application claims priority under 35 USC 119 from Japanese Patent Application Nos. 2006-269413 and 2007-104686, the disclosure of which is incorporated by reference herein.

BACKGROUND OF THE INVENTION

1. Field of the Invention

The present invention relates to an inkjet recording method and to an inkjet recording apparatus suitable for rapidly recording a high quality image by an inkjet method.

2. Description of the Related Art

Inkjet methods of ejecting ink in the form of liquid droplets from an ink ejecting port has been used in various kinds of printers for the reasons of compactness and reduced costs, the ability to form an image without contacting a recording medium, and the like. These inkjet methods include a piezo inkjet method utilizing deformation of piezoelectric elements to eject ink and a thermal inkjet method utilizing the boiling phenomenon of ink caused by thermal energy to eject ink in droplets, which methods have the characteristics of high resolution and high-speed printability.

Improvements of speed and image quality are currently important objectives for when printing is carried out by ejecting ink droplets onto a plain paper sheet or a non-water-absorbing recording medium made of plastics or the like by use of an inkjet printer.

Inkjet recording is a method of ejecting ink droplets according to image data to form a line or an image on a recording medium with the liquid droplets. However, there have been problems in practical use, particularly in the case of recording on the above described non-liquid-absorbing recording medium, namely, for example, bleeding of an image easily occurs, or mixing of adjacent ink droplets occurs on the recording medium to inhibit formation of a sharply defined image, when the drying or permeation of the liquid droplets into the recording medium after being ejected takes some time. When the liquid droplets mix with each other, ejected adjacent liquid droplets coalesce with each other to move from the positions at which they have impacted the recording medium, thereby causing unevenness in line width when forming fine lines or unevenness in color when forming a colored area, or the like. Further, since the degree of occurrence of unevenness in line width or color unevenness in a colored area varies depending on ink absorbability and the wettability of the surface of the recording medium, there has also been a problem that different images are formed between different types of recording media, even though the same ink is used under the same ejection conditions.

As a method of suppressing image bleeding or nonuniformity of line width, a method exists of promoting fixation of liquid droplets. For example, methods of using two-liquid type inks having reactivity and allowing them to react with each other on a recording medium to achieve an imaging quality with high definition, such as a method of recording with ink containing an anionic dye after application of a liquid containing a basic polymer onto a medium (for example, refer to Japanese Patent Application Laid-Open (JP-A) No. 63-60783), or a method of applying ink containing an anionic compound and a coloring material after application of a liquid composition containing a cationic substance onto a medium (for example, refer to JP-A No. 8-174997) have been disclosed.

An inkjet recording method has also been proposed in which an ultraviolet-curable ink is used as the ink, and the ejected ink dots on a recording medium are irradiated with an ultraviolet ray in conformity with the timing of ejection, then the dots are pre-cured to be thickened to such an extent that the adjacent dots do not mix with each other, and thereafter the dots are further irradiated with an ultraviolet ray to complete curing (for example, refer to JP-A No. 2004-42548).

Further, a method has been proposed that improves visibility, reduces bleeding of color ink and suppresses the problem such as variation in the obtained images formed on different types of recording media, by applying a radiation curable white ink to form a uniform undercoating layer onto a transparent or a translucent non-absorbing recording medium, then curing or thickening the layer by irradiating with a radiation ray, and thereafter recording with a radiation curable color ink (for example, refer to JP-A Nos. 2003-145745 and 2004-42525). There has also been proposed a method in which a substantially transparent active ray-curable ink is applied by an inkjet head onto a recording medium in place of the radiation curable white ink (for example, refer to JP-A No. 2005-96254).

SUMMARY OF THE INVENTION

The invention has been made in view of the above problems and provides an inkjet recording method and inkjet recording apparatus.

According to a first aspect of the invention, there is provided an inkjet recording method comprising: applying an undercoating liquid onto a recording medium, the undercoating liquid containing at least one surfactant in an amount of from 0.001% to the critical micelle concentration, the surfactant imparting a surface tension of 25 mN/m or less when the surfactant is dissolved in 1,6-hexanediol diacrylate at a critical micelle concentration; semi-curing the undercoating liquid; and recording an image by ejecting an ink onto the semi-cured undercoating liquid, the ink being curable by irradiation with an actinic ray.

According to a second aspect of the invention, there is provided an inkjet recording apparatus comprising: an undercoating liquid application device for applying an undercoating liquid on a recording medium, the undercoating liquid containing at least one surfactant in an amount of from 0.001% to a critical micelle concentration, the surfactant achieving a surface tension of 25 mN/m or lower when dissolved in 1,6-hexanediol diacrylate at a critical micelle concentration; an undercoating liquid curing device for semi-curing the undercoating liquid by applying energy to at least a portion of the undercoating liquid, the undercoating liquid curing device being disposed downstream of the undercoating liquid application device in a traveling direction of the recording medium; and an image recording device for recording an image by ejecting an ink onto the semi-cured undercoating liquid, the ink being curable by irradiation with an actinic ray, and the image recording device being disposed downstream of the undercoating liquid curing device in the traveling direction of the recording medium.

BRIEF DESCRIPTION OF THE DRAWINGS

Exemplary embodiments of the present invention will be described in detail based on the following figures, wherein.

DETAILED DESCRIPTION OF THE INVENTION

Figure 1:
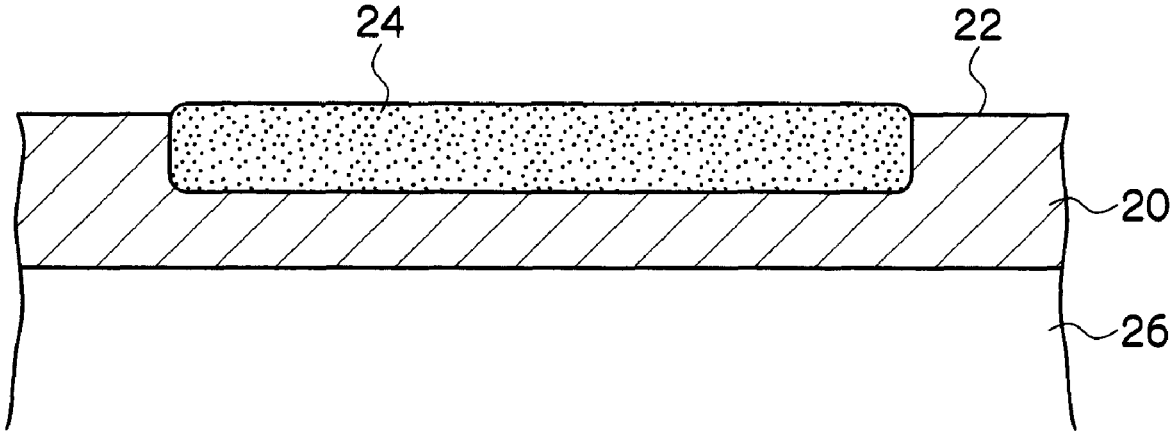
FIG. 1 is a cross schematic sectional view showing a recording medium having an image formed thereon by ejecting an ink onto a semi-cured undercoating liquid.

The inkjet recording method and the inkjet recording apparatus of the invention are further described below in detail.

The inkjet recording method of the invention includes: an undercoating liquid applying step of applying an undercoating liquid onto a recording medium, the undercoating liquid containing at least one surfactant (hereinafter also referred to as "specific surfactant" in some cases), which imparts a surface tension of 25 mN/m or less when the surfactant is dissolved in 1,6-hexanediol diacrylate at a critical micelle concentration, in an amount of 0.001% or more and the critical micelle concentration or less; a curing step of semi-curing the applied undercoating liquid; and a recording step of recording an image by ejecting an ink, which is curable by irradiation with an actinic ray, onto the semi-cured undercoating liquid. As necessary, other steps such as a step of semi-curing the ink may be provided.

Generally, in an inkjet recording method, ink droplets are ejected so as to partly overlap each other to obtain a high degree of image density and the adjacent ink droplets stay on a recording medium to contact and coalesce with each other before being dried. Therefore, image bleeding or unevenness in line width of fine lines may easily occur, thereby impairing formation of an image having high sharpness. However, in the inkjet recording method of the invention, an undercoating liquid is applied onto a recording medium and is semi-cured, and even when ink droplets are applied so as to partly overlap each other onto the semi-cured undercoating liquid, coalescence between the adjacent ink droplets can be suppressed by the interaction between the undercoating liquid and the ink droplets. As a result, image blurring, unevenness in line width of fine lines in an image, and color unevenness of colored surface are effectively prevented.

In addition, the undercoating liquid according to the invention contains at least one surfactant (specific surfactant), which imparts a surface tension of 25 mN/m or less when the surfactant is dissolved in 1,6-hexanediol diacrylate at a critical micelle concentration, in an amount within the above-described specific range, hence the impinged ink droplets moderately spread to connect dots one another. However, the degree of spread is suppressed so as not to deteriorate the dot shape or cause image disturbance or blurring, which prevents the occurrence of white voids, and allows recording of an image with a high density entirely over the image and fine reproducibility.

Therefore, the inkjet recording method of the invention allows the formation of a sharp line having a uniform width, and improves the reproducibility of a fine image such as a thin line in the image with no occurrence of white spots or density decrease in a reverse image or solid image.

The inkjet recording method of the invention is effective, for example, for recording an image onto an impermeable or low permeable recording medium having low liquid absorbency.

In the invention, the description "adjacent ink droplets" refers to the liquid droplets ejected from an ink ejecting port with an ink of a single color so as to have an overlapping portion, or the liquid droplets ejected from an ink ejecting port with inks of different colors to have an overlapping portion. The adjacent ink droplets may be the liquid droplets that are ejected at the same time, or may be composed of the preceding liquid droplets and the subsequent liquid droplets where the former are ejected prior to the ejection of the latter.

In the invention, at least one kind of ink and at least one kind of undercoating liquid are used as the liquids for formation of an image. The undercoating liquid preferably has a different composition from that of the ink. The undercoating liquid is preferably applied onto the region that is equal to, or larger than, the region on which an image is formed by ejecting ink droplets onto a recording medium.

Further, the ink in the invention is preferably used as inks of plural colors in a multicolor ink set. In the case of using the multicolor ink set, it is preferable that after each ejection of the ink of each color, semi-curing of the ink is further performed.

In one specific embodiment of the inkjet recording method of the invention, ink droplets of a plural colors ejected onto a recording medium contain a polymerizable or crosslinkable material to form an image, and includes previously applying an undercoating liquid having a composition different from that of the inks and containing a polymerizable or crosslinkable material, onto a recording medium in the identical or larger region as the image to be formed by the ink droplets, semi-curing the undercoating liquid by the application with an actinic ray or heat, and ejecting ink droplets of a plural colors onto the undercoating liquid which has been semi-cured by the application of the actinic ray or heat.

From the viewpoint of achieving excellent fixing properties for inks, the above-described steps of previously applying an undercoating liquid and ejecting at least all of desired ink droplets (preferably multi-color ink droplets) are preferably followed by a step of fixing the recorded image by, for example, applying energy to further accelerate curing of the undercoating liquid and ejected ink (hereinafter referred to as "fixing step").

-Undercoating Liquid Applying Step, Recording Step-

In the undercoating liquid applying step, an undercoating liquid is applied onto a recording medium. The undercoating liquid contains at least one surfactant (hereinafter may be referred to as "specific surfactant") which imparts a surface tension of 25 mN/m or less when the surfactant is dissolved in 1,6-hexanediol diacrylate at a critical micelle concentration, and is preferably composed of a radical polymerizable composition and a surfactant. If necessary, the undercoating liquid may further contain other components. The components of the undercoating layer and the detail of the recording medium will be described later.

In the recording step, an image is recorded by ejecting an ink, which is curable by irradiation with an actinic ray, on the undercoating liquid which has been semi-cured in the below-described curing step. The ink is applied in the form of droplets using inkjet nozzles or the like on the semi-cured undercoating liquid.

In the inkjet recording method of the invention, the undercoating liquid can be applied onto the recording medium using a coating device, an inkjet nozzle, and the like.

(i) Application Using an Application Device

In the invention, an embodiment is preferable in which an image is recorded by applying an undercoating liquid onto a recording medium using an application device, and thereafter ink droplets are ejected using an inkjet nozzle. Details of the inkjet nozzle will be discussed later.

The application device is not particularly limited and can suitably be selected from known application devices according to purposes. Examples of the application devices include an air doctor coater, blade coater, lot coater, knife coater, squeeze coater, immersion coater, reverse roll coater, transfer roll coater, gravure coater, kiss roll coater, cast coater, spray coater, curtain coater and an extrusion coater. Details of these coating devices can be referred to Yuji Harasaki, "Coating Engineering", 1978.

(ii) Ejection from Inkjet Nozzle

In the invention, an embodiment is also preferable in which an image is recorded by ejecting an undercoating liquid by an inkjet nozzle, and thereafter ink droplets are ejected by the inkjet nozzle. Details of the inkjet nozzle will be discussed later.

As the conditions for applying of the undercoating liquid by the inkjet nozzle, it is preferable that the undercoating liquid is ejected by a head capable of ejecting droplets having a greater liquid amount per droplet and having lower nozzle density as compared with the head for an ink, and the head is arranged as a full-line head unit in a width direction of the recording medium. Such a head ejecting droplets having a greater liquid amount per droplet generally has a high degree of ejection power, and is therefore applicable to an undercoating liquid having a high viscosity, and is also advantageous in terms of avoiding nozzle clogging. Further, use of a head capable of ejecting droplets having a greater liquid amount per droplet is also advantageous from the viewpoint that an inexpensive head having a lower driving frequency can be applied, since the droplet resolution of the undercoating liquid in a conveyance direction of a recording medium can be reduced.

In either case of the above embodiments, liquids other than the undercoating liquid and ink can be further applied. Any methods such as applying by an application device or ejecting from an inkjet nozzle can be applied to the application of such liquids, and the timing thereof is also not particularly limited. When a colorant is contained in the liquid other than the undercoating liquid and ink, the liquid is preferably applied by ejecting from an inkjet nozzle, and is preferably applied after the undercoating liquid has been applied.

Next, a method of ejecting by an inkjet nozzle (inkjet recording method) will be discussed.

In the invention, known inkjet recording methods are preferably used, such as an electrostatic induction method in which an ink is ejected by means of electrostatic power, drop-on-demand method (pressure-pulse method) utilizing vibration pressure of a piezoelectric element, acoustic inkjet method in which ink is ejected by means of radiation pressure caused by irradiating the ink with an acoustic beam which has been converted from an electric signal, and a thermal inkjet method of utilizing the pressure generated by heating ink to form air bubbles.

Further, in the inkjet recording methods, there are also a method in which an ink having a low color density called "photo ink" is ejected as a large number of droplets having a small volume; a method in which image quality is improved by using multiple inks having substantially the same color hue but different concentrations; a method of using a clear and transparent ink, and the like.

In the invention, the ink ejected on the semi-cured undercoating liquid is preferably ejected to a droplet size of from 0.1 pL (picoliter, hereinafter the same) to 100 pL (preferably from an inkjet nozzle). When the droplet size is within the above range, an image with a high sharpness and a high density can effectively be formed. The droplet size is more preferably in the range of from 0.5 pL to 50 pL.

The amount of the undercoating liquid to be applied in terms of mass ratio per area is preferably from 0.05 to 5, more preferably from 0.07 to 4, and still more preferably from 0.1 to 3, when the ink quantity per one droplet is taken as 1.

The ejection interval between the application of the undercoating liquid and the ejection of the ink droplet is preferably in the range of from 5μ seconds to 10 seconds. When the ejection interval is within the above range, the effect of the invention can be remarkably achieved. The ejection interval of the ink droplet is more preferably in the range of from 10μ seconds to 5 seconds, and particularly preferably from 20μ seconds to 5 seconds.

In the recording step, a multi-color image may be recorded using an ink set containing a plurality of color inks. In this case, from the viewpoints of reproducibility of a fine image and color rendition, it is preferable to provide a step of semi-curing one color ink or two or more color inks of the plurality of color inks ejected on the recording medium, in which the one color ink or each of the specified number of color inks is subjected to light exposure (so-called pinning exposure).

An actinic ray is suitable for the pinning exposure, and the detail of the actinic ray is the same as that in the below-described fixing step. Examples of the actinic ray include UV light, visible light, α rays, γ rays, X rays, and electron beams. Among them, UV light and visible light are preferable, and UV light is particularly preferable from the viewpoints of cost and safety.

The amount of energy necessary for the semi-curing varies according to the type and content of the polymerization initiator, and in general, preferably from 1 $mJ/cm^2$ to 500 $mJ/cm^2$.

-Curing Step-

In the curing step, the undercoating liquid which has been applied in the undercoating liquid applying step is semi-cured.

According to the invention, a step of semi-curing the applied undercoating liquid is provided between after applying the undercoating liquid and before ejecting at least one kind of ink droplets in the recording step.

The semi-curing of the undercoating liquid is further described below.

According to the invention, "semi-cured" means, "partially cured or partial curing", and refers to a state where the undercoating liquid is not completely cured but partially cured. In the case where the undercoating liquid, which has been applied to the recording medium (base material), is semi-cured, the degree of curing may be uneven. For example, the degree of curing of the undercoating liquid preferably becomes higher in the depth direction of the undercoat layer.

In the case where a radical polymerizable undercoating liquid is used in air or air which may be partially replaced with an inert gas, radical polymerization tends to be hindered on the surface of the undercoating liquid due to the radical polymerization hindering effect of oxygen. As a result, the degree of curing is uneven, and curing proceeds more quickly in the inner portion of the undercoating liquid, and curing of the surface tends to be retarded.

Also in the case where the cationic polymerizable undercoating liquid is used in humid air, curing proceeds more quickly in the inner portion of the undercoat layer, and curing of the surface tends to be retarded due to the cationic polymerization hindering effect of moisture.

According to the invention, when the radical photopolymerizable undercoating layer is used and partially photocured in the presence of oxygen which inhibits radical polymerization, the degree of curing of the undercoating layer is higher in the inner portion than the outer portion.

When an ink (colored liquid) is ejected onto the semi-cured undercoating layer, a favorable technical effect is exerted on the quality of the image formed on the recording medium. The action mechanism is confirmed through the cross sectional observation of the recording medium having an image formed thereon.

For example, a high-density portion formed by ejecting about 12 pL of ink on a semi-cured undercoating layer having a thickness of about 5μm and being provided on a base material is described below.

According to the invention, the undercoating layer is semi-cured, and the degree of curing is higher at the side nearer to the base material than the side far from the base material, or the surface layer. In this case, following three features are observed: as shown in FIG. 1, (1) an ink 24 is partially exposed above the surface (undercoating layer surface 22), (2) the ink 24 is partially underlaid in an undercoat layer 20, and (3) the undercoating layer 20 is present between the ink 24 and a base material 26. More specifically, the recording medium having an image formed thereon by applying the ink 24 to the semi-cured undercoat layer 20 has a cross section as schematically shown by FIG. 1. In the case where the above-described condition (1), (2), or (3) is satisfied, it may be regarded that the ink has been applied to the semi-cured undercoating layer. In this case, the ink droplets ejected with a high density are connected each other to form a colored film, which provides an even and high color density.

Figure 2A:
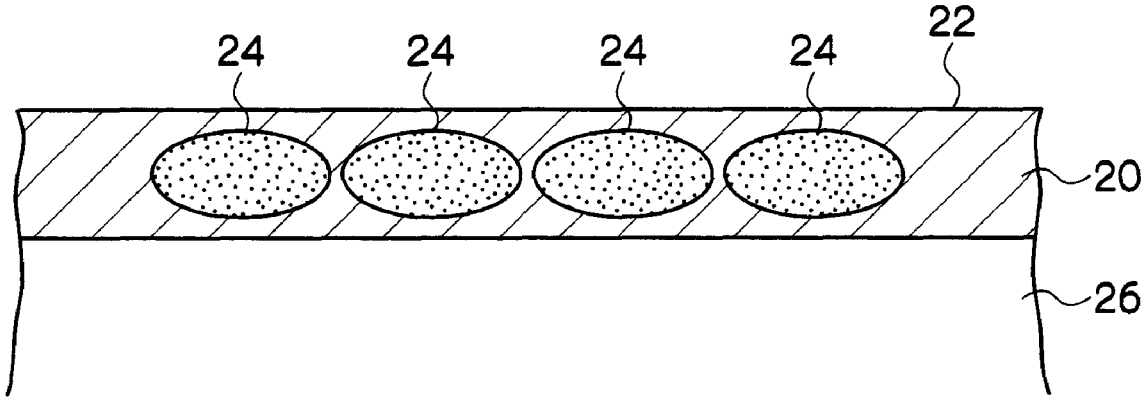
FIGS. 2A and 2B are schematic sectional view showing a recording medium having an image formed thereon by ejecting an ink onto an uncured undercoating liquid.
Figure 2B:
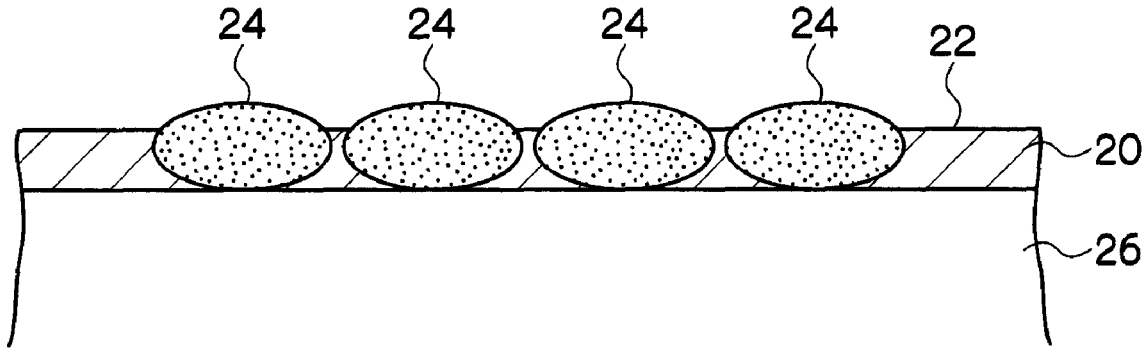

On the other hand, if an ink is ejected onto an uncured undercoating layer, as shown in FIG. 2A, the ink 24 is entirely underlaid in the undercoat layer 20, and/or, as shown in FIG. 2B, no undercoating liquid 20 is present between the ink 24 and the base material 26. In this case, even if the ink is applied with a high density, droplets are independent from each other, which causes the decrease in the color density. The recording medium having an image formed thereon by applying the ink 24 to the uncured undercoating layer 20 has a cross-sectional view as schematically shown in FIGS. 2A and 2B.

Figure 2C:
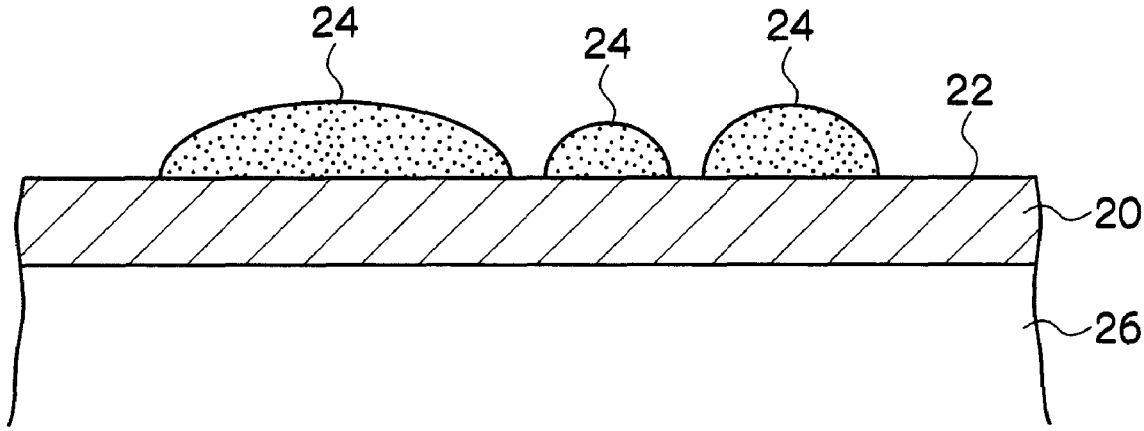
FIG. 2C is a schematic cross sectional view showing a recording medium having an image formed thereon by ejecting an ink onto a completely cured undercoating liquid.

Further, in the case where the ink is ejected onto a completely cured undercoating layer, as shown in FIG. 2C, the ink 24 is not underlaid in the undercoating layer 20. Such a state causes inter-droplet interference, which hinders the formation of a uniform ink film and causes the deterioration in the color reproducibility. The recording medium having an image formed thereon by applying the ink onto the completely cured undercoating layer has a cross-sectional view as schematically shown in FIG. 2C.

In the case where ink droplets are applied with a high density, from the viewpoint of forming a uniform ink liquid layer in which ink droplets are not independent from each other, and preventing the occurrence of inter-droplet interference, the amount of the uncured portion of the undercoating layer per unit area is preferably sufficiently smaller than the maximum amount of the ink droplets applied to a unit area. More specifically, the relationship between the mass M (undercoating liquid) of the uncured portion of the undercoating layer per unit area and the maximum mass m (ink) of the ink ejected to the unit area is preferably "m (ink)/30<M (undercoating layer)<m (ink)", more preferably "m (ink)/20<M (undercoating layer)<m (ink)/3", and particularly preferably "m (ink)/10<M (undercoating layer)<m (ink)/5". The maximum mass of the ink ejected onto a unit area is the maximum mass of one color.

When the relationship m (ink)/30<M (undercoat layer) is satisfied, the occurrence of inter-droplet interference can be prevented, and excellent dot size reproducibility can be achieved. Further, when the relationship M (undercoating liquid)<m (ink) is satisfied, a uniform ink liquid layer is formed, and a high image density can be obtained.

The mass of the uncured portion of the undercoating layer per unit area is determined by the transfer test described below. More specifically, a liquid permeable medium such as plain paper is pressed against the semi-cured undercoating layer at a time after the semi-curing process has completely finished (for example, after irradiation with an actinic ray) and before ink droplets are ejected, and then the mass of the liquid transferred from the undercoating layer to the permeable medium is measured to determine the uncured portion.

For example, when the maximum ink ejection volume is 12 picoliters per one pixel at an inkjet density of 600×600 dpi, the maximum ink mass m ejected onto a unit area is 0.04 $g/cm^2$ (on the assumption that the ink density is about 1.1 $g/cm^3$). Accordingly, the mass of the uncured portion of the undercoating layer is preferably larger than 0.0013 $g/cm^2$ and lower than 0.04 $g/cm^2$ per unit area, more preferably larger than 0.002 $g/cm^2$ and lower than 0.013 $g/cm^2$, and particularly preferably larger than 0.004 $g/cm^2$ and lower than 0.008 $g/cm^2$.

Figure 3:
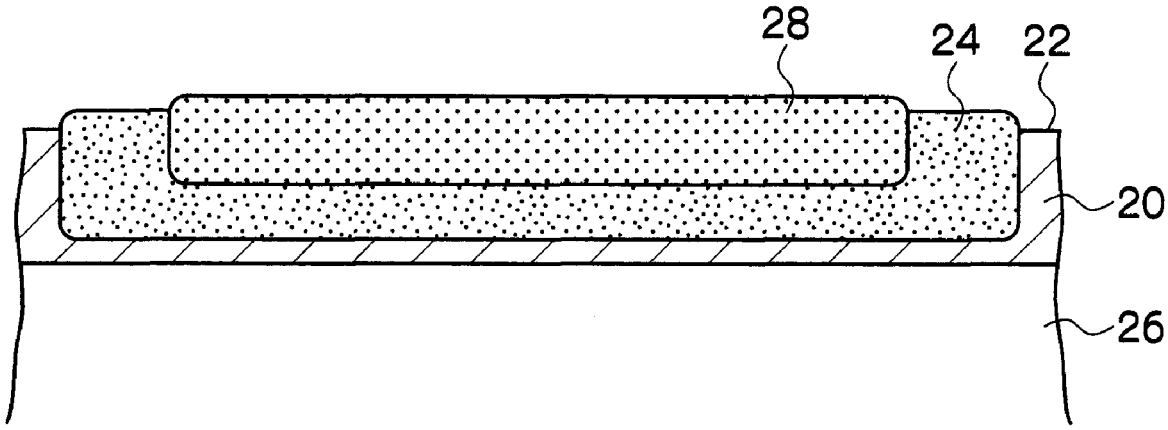
FIG. 3 is a schematic cross sectional view showing a recording medium having an image formed thereon by ejecting the ink B onto the uncured ink A.

In the case where a secondary color is formed using two color inks (for example, inks A and B), for example, the ink B may be applied to the semi-cured ink A. When the ink B is ejected onto the semi-cured ink A, as shown in FIG. 3, the ink B28 is partially underlaid into the ink A24, and the ink A24 is present as an underlayer of the ink B28. More specifically, the recording medium having an image formed thereon by applying the ink B28 onto the semi-cured ink A24 has a crosssection as schematically shown in FIG. 3. The cured ink A film and the cured ink B film are layered so that allows favorable color reproduction can be achieved.

Figure 4A:
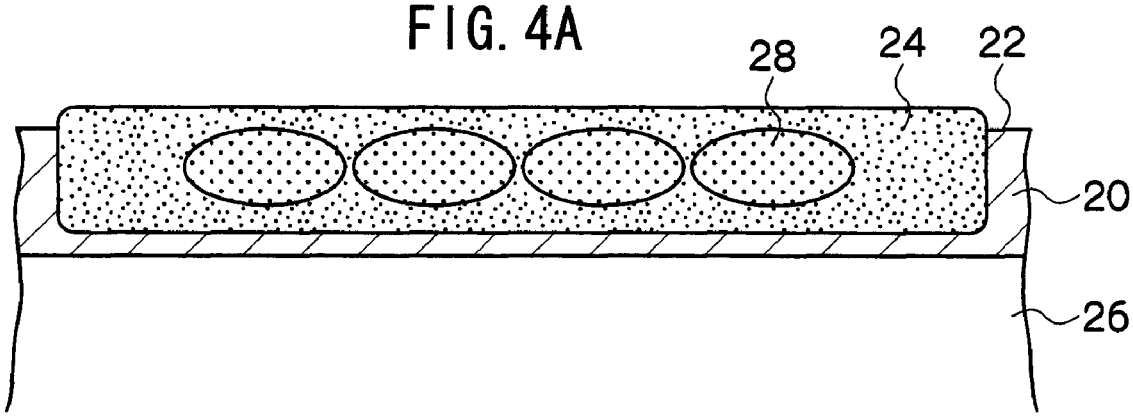
FIG. 4A and FIG. 4B are schematic cross sectional view showing a recording medium having an image formed thereon by ejecting the ink B onto the uncured ink A.
Figure 4B:
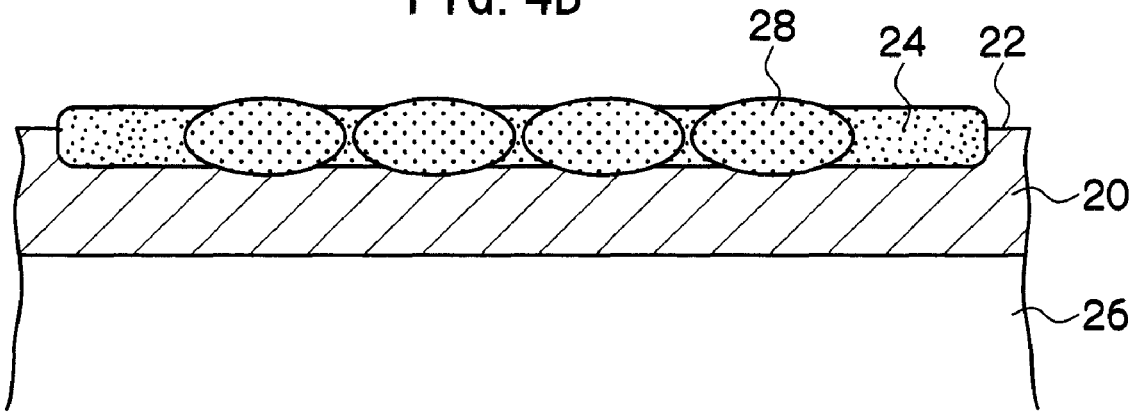

On the other hand, in the case where the ink B is ejected onto the uncured ink A, as shown in FIG. 4A, the ink B28 is entirely underlaid in the ink A24, and/or, as shown in FIG. 4B, the state that the ink A24 is not present under the ink B28 arises. In this case, even if the ink B droplets are applied with a high density, the droplets are independent from each other, which results in reduction in color saturation of the secondary color. A printed material obtained by applying the ink B28 onto the uncured ink A24 has a cross-section as schematically shown in FIGS. 4A and 4B.

Figure 4C:
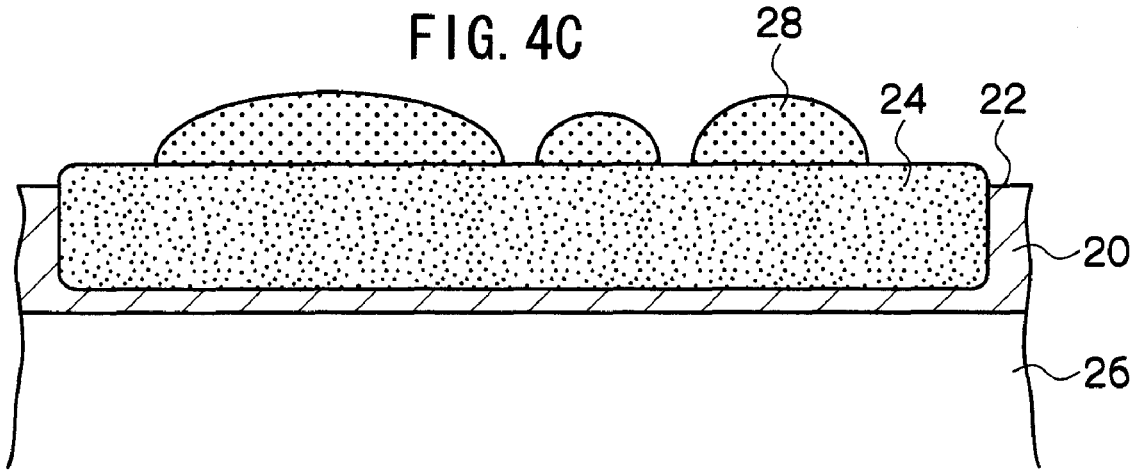
FIG. 4C is a schematic cross sectional view showing a recording medium having an image formed thereon by ejecting the ink B on the completely cured ink A.

In the case where the ink B is ejected onto the completely cured ink A, as shown in FIG. 4C, the ink B28 is not underlaid in the ink A24. Such a state may cause inter-droplet interference, which hinders the formation of an even ink film and causes the deterioration in the color reproducibility. The recording medium having an image formed thereon by applying the ink B28 to the completely cured ink A24 has a cross-section as schematically shown in FIG. 4C.

In the case where the droplets of the ink B are applied with a high density, from the viewpoint of forming a uniform liquid layer of the ink B without independence of droplets from each other, and preventing the occurrence of inter-droplet interference, the amount of the uncured portion of the ink A per unit area is preferably sufficiently smaller than the maximum liquid amount of ink droplets of the ink B applied to a unit area. More specifically, the relationship between the mass M (ink A) per unit area of the uncured portion of the ink A layer and the maximum mass m (ink B) of the ink B layer ejected to a unit area is preferably "m (ink B)/30<M (ink A)<m (ink B)", more preferably "m (ink B)/20<M (ink A)<m (ink B)/3", and particularly preferably "m (ink B)/10<M (ink A)<m (ink B)/5".

When the relationship m (ink B)/30<M (ink A) is satisfied, the occurrence of inter-droplet interference is prevented, and excellent dot size reproducibility is achieved. Further, when the relationship M (ink A)<m (ink B) is satisfied, a uniform ink liquid layer is formed, and a high density is achieved.

The mass of the uncured portion of the ink A per unit area is determined by the transfer test described below. More specifically, a permeable medium such as plain paper is pressed against the semi-cured ink A layer at a time after the semi-curing process has completely finished (for example, after irradiation with an actinic ray) and before ink B droplets are ejected, and then the mass of the liquid in the ink A layer from the undercoating layer to the permeable medium is measured to determine the uncured portion.

For example, when the maximum ejection volume of ink B is 12 picoliters per one pixel at an inkjet density of 600×600 dpi, the maximum mass m of the ink B ejected onto a unit area is 0.04 g/cm$^2$ (on the assumption that the density of the ink B is about 1.1 g/cm$^3$). Accordingly, the mass of the uncured portion of the ink A layer is preferably higher than 0.0013 g/cm$^2$ and less than 0.04 g/cm$^2$ per unit area, more preferably higher than 0.002 g/cm$^2$ and less than 0.013 g/cm$^2$, and particularly preferably higher than 0.004 g/cm$^2$ and less than 0.008 g/cm$^2$.

In the cases where the curing reaction is based on an ethylenic unsaturated compound or cyclic ether, the nonpolymerization rate may be quantitatively determined from the reaction rate of the ethylenic unsaturated group or cyclic ether group, which will be described later.

In the case where the semi-cured state of the undercoating liquid and/or ink is achieved by polymerization reaction of a polymerizable compound initiated by irradiation with an actinic ray or heating, from the viewpoint of improving the abrasion resistance of the printed material, the nonpolymerization rate (A(after polymerization)/A(before polymerization)) is preferably 0.2 or more and 0.9 or less, more preferably 0.3 or more and 0.9 or less, and particularly preferably 0.5 or more and 0.9 or less.

The term A (after polymerization) refers to an absorbance at the infrared absorption peak of the polymerizable group after polymerization reaction, and A (before polymerization) refers to an absorbance at the infrared absorption peak of the polymerizable group before polymerization reaction. For example, in the case where the polymerizable compound contained in the undercoating liquid and/or ink is an acrylate or methacrylate monomer, an absorption peak based on a polymerizable group (acrylate or methacrylate group) is observed in the vicinity of 810 cm$^{-1}$, and the absorbance at the peak is preferably used for defining the nonpolymerization rate. In the cases where the polymerizable compound is an oxetane compound, an absorption peak based on a polymerizable group (oxetane ring) is observed in the vicinity of 986 cm$^{-1}$, and the absorbance at the peak is preferably used for defining the degree of nonpolymerization. In the case where the polymerizable compound is an epoxy compound, an absorption peak based on a polymerizable group (epoxy group) is observed in the vicinity of 750 cm$^{-1}$, and the absorbance at the peak is preferably used for defining the nonpolymerization rate.

The device for measuring the infrared absorption spectrum may be a commercial infrared spectrophotometer. The spectrophotometer may be of transmission or reflection type, and is preferably selected according to the form of the sample. For example, an infrared spectrophotometer FTS-6000, manufactured by BIO-RAD may be used for the measurement.

The viscosity (25° C.) of the semi-cured undercoating liquid is preferably 5000 mPa·s or more. The viscosity (25° C.) of the surface portion of the semi-cured undercoating liquid is preferably 100 mPa·s or more and 5000 mPa·s or less. Each of the viscosities of the surface portion and the inner portion of the undercoating liquid is determined by scraping up the portions individually, and measuring the viscosity of the each portion using a commercial viscometer (for example, a lab-use handy digital viscometer VISCOSTICK, manufactured by MARUYASU CORP.).

The viscosity (25° C.) of the inner portion of the semi-cured undercoating liquid is 1.5 times or more, preferably twice or more, and more preferably three times or more of the viscosity (25° C.) of the surface portion of the semi-cured undercoating liquid from the viewpoint of suppressing coalescence between adjacent ink droplets caused by the interaction between the undercoating liquid and the ink droplets.

The methods for semi-curing the undercoating layer may be known methods for increasing viscosity, and examples thereof include: (1) a method of utilizing a so-called aggregation phenomenon by adding a basic compound to an acidic polymer, or adding an acidic compound or metallic compound to a basic polymer; (2) a method of adjusting the viscosity of the undercoating liquid by preliminarily preparing the undercoating liquid to have a high viscosity, then adding an organic solvent having a low boiling point to the undercoating liquid to decrease the viscosity thereof, and thereafter bringing the undercoating liquid back to have the high viscosity by evaporating the organic solvent having a low boiling point; (3) a method of lowering the viscosity by heating the undercoating liquid which has previously been prepared to have a high viscosity to decrease the viscosity, then cooling the undercoating liquid back to have the high viscosity; and (4) a method of causing a curing reaction by applying an actinic energy ray or heat to the undercoating liquid. Among these, (4) a method of causing a curing reaction by applying an actinic ray or heat to the undercoating liquid is most preferable.

The method of applying an actinic ray or heat to cause the curing reaction is a method of insufficiently achieving polymerization reaction of the polymerizable compound on the surface of the undercoating layer applied to the recording medium. Polymerization reaction is more readily inhibited at the surface than in the inner portion of the undercoating layer because of the influence of oxygen in air. Accordingly, the undercoating layer can be semi-cured by controlling the conditions for applying an actinic ray or heat.

The details of the actinic ray are the same as those in the below-described fixing step. Examples of the actinic ray include UV light, visible light, α rays, γ rays, X rays, and electron beams. Among them, UV light and visible light are preferable, and UV light is particularly preferable from the viewpoint of cost and safety.

The amount of energy necessary for semi-curing the undercoating liquid varies according to the type and content of the polymerization initiator. In the case where energy is applied by an actinic ray, the amount of energy is preferably 1 to 500 $mJ/cm^2$ in common cases. On the other hand, in the case where energy is applied by heating, the recording medium is preferably heated for 0.1 to 1 second under conditions that the surface temperature of the recording medium is in the range of 40 to 80° C.

By applying an actinic ray or heat such as active light or heating, generation of the active species due to decomposition of the polymerization initiator is promoted, and the curing reaction due to polymerization or crosslinking of a polymerizable or crosslinkable material caused by the active species is promoted by the increase in the amount of the active species and the increase in temperature.

Thickening (increasing in the viscosity) can also be favorably performed by irradiation with active light or heating.

The above description on the semi-curing of the undercoating layer is also applicable to the semi-curing of ink (hereinafter, also referred to as "ink liquid" in some cases).

-Fixing Step-

The fixing step is preferably performed after the undercoating liquid applying step, curing step, and recording step. In the fixing step, for example, energy is applied to accelerate further the curing of the undercoating liquid and ejected ink to fix the recorded image.

In the case where a polymerizable or crosslinkable material is contained, curing reaction of the material through polymerization or crosslinking may be accelerated by applying energy for forming an image more efficiently and more solidly. For example, a system containing a polymerization initiator, application of active energy such as an actinic ray or heating accelerates the generation of active species through the decomposition of the polymerization initiator, and at the same time, the increase in the active species and temperature accelerates the polymerization or curing reaction of the polymerizable or crosslinking material attributed to the active species.

Application of energy can favorably be performed by irradiation with an actinic ray or heating. As the actinic ray, similar one which will be discussed later as the actinic ray for image fixation can be used, such as an ultraviolet ray, visible ray, α ray, γ ray, X ray and electron beam, wherein the ultraviolet ray and visible ray are preferable and ultraviolet ray are particularly preferable, from the viewpoint of cost and safety.

Further, the heating can be performed using a non-contact type heating device, and preferable ones include a heating device in which the recording medium passes through, such as an oven, or a heating device in which flood exposure is performed with light in the range of ultraviolet light-visible light-infrared light, or the like. Examples of the preferable light sources for use in exposure as a heating device include a metal halide lamp, xenon lamp, tungsten lamp, carbon arc lamp and a mercury lamp.

When the energy is applied by irradiation with an actinic light, the amount of the energy required for curing reaction varies depending on the type or content of the polymerization initiator, but is generally preferably from about 100 to about 10000 $mJ/cm^2$. When the energy is applied by heating, it is preferable to heat a recording medium under such conditions that the surface temperature of the recording medium becomes from 40 to 80° C., for a period of time of from 0.1 to 1 second.

(Curing Sensitivity of Ink and Undercoating Liquid)

According to the invention, the curing sensitivity of the ink is preferably not lower than the curing sensitivity of the undercoating liquid. More preferably, the curing sensitivity of the ink is not lower than the curing sensitivity of the undercoating liquid, and not higher than four times the curing sensitivity of the undercoating liquid. Further preferably, the curing sensitivity of the ink is not lower than the curing sensitivity of the undercoating liquid and not higher than twice the curing sensitivity of the undercoating liquid. Most preferably, the ratio is 1.5 times or less.

When the curing sensitivity of the ink is not lower than the curing sensitivity of the undercoating liquid, in multi-color printing, the diameter and shape of dots are uniform among ink droplets ejected onto the undercoating liquid and ink droplets onto previously ejected ink liquid.

The curing sensitivity refers to the amount of energy necessary for completely curing the ink and/or undercoating liquid using a mercury lamp (for example, an ultrahigh pressure, high pressure, or medium pressure mercury lamp, preferably an ultrahigh pressure mercury lamp). The sensitivity becomes higher as the amount of energy becomes smaller. Accordingly, when the curing sensitivity is doubled, the amount of energy is halved.

When the curing sensitivities are equal each other, it means that the difference of the curing sensitivity between the two to be compared is twice or less.

The curing sensitivity was determined as follows: the ink was irradiated with different exposing amounts of light, the cured ink was brought into contact with KAYDRY (Manufactured by NIPPON PAPER CRECIA CO., LTD.), and the amount of light at which no ink was transferred to KAYDRY was taken as the curing sensitivity.

(Physical Properties of Ink and Undercoating Liquid)

The physical properties of the ink (droplets) ejected by the use of an inkjet recording system onto a recording medium vary with apparatuses to be used. In common cases, the viscosity at 25° C. is preferably in the range of 5 to 100 mPa·s, and more preferably in the range of 10 to 80 mPa·s. The viscosity (25° C.) of the undercoating liquid before semi-curing is preferably in the range of 100 to 5000 mPa·, and more preferably in the range of 200 to 3000 mPa·s.

According to the inkjet recording method of the invention, from the viewpoint of forming dots having a desired size on the recording medium and imparting the connectivity of dots each other, the undercoating liquid is required to contain a specific surfactant. The specific surfactant will be described later.

(Specific Surfactant)

The undercoating liquid according to the invention contains, as described above, at least one surfactant (specific surfactant) which imparts a surface tension of 25 mN/m or lower when the surfactant is dissolved in 1,6-hexanediol diacrylate at a critical micelle concentration.

The method for selecting the specific surfactant is specifically described below.

First, 0.01 to 1 g of a surfactant which may be used is dissolved in 100 ml of 1,6-hexanediol diacrylate, and the surface tension of the solution is measured. Since the surface tension is not lowered even if the surfactant is added in excess of the critical micelle concentration, the surface tension, which is not lowered independently of a further increase in the amount of the surfactant, is regarded as the surface tension at the critical micelle concentration of the surfactant. A surfactant, which imparts a surface tension of 25 mN/m or lower which is obtained by this method, is used as the surfactant according to invention.

The above-described surface tension is measured according to the Wilhelmy method at a liquid temperature of 20° C., and 60% RH using a commonly used surface tensiometer (for example, a surface tensiometer CBVP-Z manufactured by Kyowa Interface Science Co., Ltd.).

The specific surfactant is not particularly limited as long as it has the above-described properties.

The surfactant having the properties is preferably a fluorine-based or silicon-based surfactant. However, some fluorine-based or silicon-based surfactants may not have the properties according to the invention, and such surfactants are certainly not regarded as the surfactant according to the invention. If the properties according to the invention are exhibited, the surfactant used in the invention may be a nonionic surfactant, cationic surfactant, anionic surfactant, amphoteric surfactant, or any other surfactant. The above-described specific surfactants may be used in combination of two or more of them.

Among the above-described surfactants, a nonionic surfactant is preferable from the viewpoint of exerting the effect of the invention.

In light of the above, a fluorine-based or silicon-based nonionic surfactant is preferably used.

The nonionic fluorine-based surfactant used in the invention is not particularly limited. Examples of the surfactants include a perfluoroalkyl ethylene oxide adduct and a perfluoroalkyl-containing oligomer.

According to the invention, the nonionic fluorine-based surfactant used in the invention is preferably a copolymer of the monomer represented by the following formula (a) and the monomer represented by the following formula (b).

Formula (a)

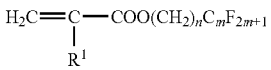

In the formula (a), $R^1$ represents a hydrogen atom or a methyl group, and is preferably a hydrogen atom. n represents an integer of 1 to 18, and 1 to 10. m represents an integer of 2 to 14, and is preferably an integer of 3 to 8.

In preferred examples of the monomer represented by the formula (a), $R^1$ is a hydrogen atom, n is from 2 to 3, and m is from 3 to 8. In a more preferable aspect, $R^1$ is a hydrogen atom, n is from 2 to 3, and m is 5 or 6.

Formula (b)

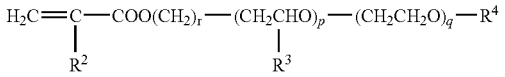

In the formula (b), $R^2$ and $R^3$ each independently represent a hydrogen atom or a methyl group, and $R^2$ is preferably a hydrogen atom and $R^3$ is preferably a methyl group, respectively. $R^4$ represents a hydrogen atom, an alkyl group having 1 to 5 carbon atoms, or a hydroxyl group, and is preferably a hydrogen atom or a hydroxyl group. p, q, and r each independently represent an integer of 0 to 18, and is preferably an integer of 0 to 6. p and q cannot be 0 at the same time. In a preferable aspect of the monomer represented by the formula (b), $R^2$ is a hydrogen atom, $R^3$ is a methyl group, $R^4$ is a hydrogen atom or a hydroxyl group, p is from 0 to 3, q is from 1 to 6, and r is 1.

In the above-described copolymer, the mass ratio between the monomer represented by the formula (a) and the monomer represented by the formula (b) is preferably 10/90 to 70/30, and particularly preferably 20/80 to 60/40.

The nonionic fluorine-based surfactant used in the invention may be a commercially available surfactant. Examples of the surfactants exhibiting the surface tension according to the invention include MEGAFAC series such as F479, F470, and F475 (manufactured by Dainippon Ink & Chemicals, Incorporated), and FSN-100 (manufactured by Du Pont K.K.).

As the nonionic silicon-based surfactant, a polysiloxane compound is particularly preferably used.

The polysiloxane compound, which may be used in the invention, is a compound which contains two or more Si—O bonds (siloxane bond), and is composed of at least silicon, oxygen, and hydrogen. The polysiloxane compound contained in a processing liquid is not particularly limited, but preferably a polymer represented by the following formula (c).

Formula (c)

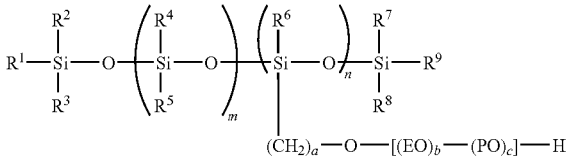

[In the formula (c), $R^1$ to $R^9$ each independently represent an alkyl group having 1 to 4 carbon atoms or a hydrogen atom, and a, b, c, m, and h each independently represent an integer of 0 or more. E represents ethylene, and P represents propylene.]

In the formula (c), the alkyl groups having 1 to 4 carbon atoms represented by $R^1$ to $R^9$ are preferably methyl groups or ethyl groups, and more preferably methyl groups. The weight average molecular weight of the polysiloxane compound represented by the formula (c) is preferably 500 to 50000, more preferably 1000 to 30000, and particularly preferably 2000 to 20000.

The nonionic silicon-based surfactant used in the invention may be a commercially available surfactant.

Examples of the surfactants exhibiting the surface tension according to the invention include KF945, KF414 (manufactured by SHIN-ETSU CHEMICAL CO., LTD.), and BYK-307 (manufactured by BYK-CHEMIE).

A surfactant other than the surfactant according to the invention may be added within the range which does not impair the effect of the invention. Examples of the surfactants include, in addition to the above-described fluorine-based and silicon-based surfactants, anionic surfactants such as dialkylsulfosuccinates, alkyl naphthalene sulfonates, and fatty acid salts, nonionic surfactants such as polyoxyethylenealkyl ethers, polyoxyethylene alkyl allyl ethers, acetylene glycols, polyoxyethylene-polyoxypropylene block copolymers, and cationic surfactants such as alkylamine salts and quaternary ammonium salts. Other examples include the surfactants described in JP-A Nos. 62-173463 and 62-183457.

According to the invention, the addition amount of the specific surfactant which may be added to the undercoating liquid is 0.001% by mass or more and the critical micelle concentration or lower. In order to connect more distant dots between the adjacent droplets with a smaller amount of ink solution, the addition amount is preferably 0.001% by mass or more and not higher than half the critical micelle concentration, and more preferably 0.001% by mass or more and not higher than quarter the critical micelle concentration.

According to the invention, when the addition amount of the specific surfactant is 0.001% by mass or more and not higher than half the critical micelle concentration, dots of ejected droplets are connected (dot connectivity is provided) with a small amount of ink solution, which provide an image having excellent uniformity, suppresses the occurrence of uneven line width and color unevenness caused by ink bleeding or coalescence between droplets. In addition, in the case where an image area having a low dot density (for example, an image with low resolution or density) is recorded with a small amount of ink, a uniform dot diameter is maintained, and the image is recorded with a high density and high reproducibility in every detail regardless of the image form.

-Recording Medium-

Any recording medium of a liquid permeable, liquid non-permeable or liquid retardant permeable medium can be used as the recording medium in the inkjet recording method in the invention. Among these, a liquid non-permeable and a liquid retardant permeable recording medium are preferable from the viewpoint of exerting the effect of the invention remarkably. The liquid permeable recording medium refers to, for example, a recording medium having such properties that when a liquid droplet of 10 pL (pico liter) is dropped onto the recording medium, the permeation time for the total amount of the droplet is 100 ms or less. The liquid non-permeable recording medium refers to "liquid does not substantially permeate into the medium", for example, under the conditions where the permeability of the liquid droplets after the lapse of time of one minute is 5% or less. The retardant permeable recording medium refers to a recording medium having such properties that when a liquid droplet of 10 pL (pico liter) is dropped onto the recording medium, the permeating time for the total amount of the droplet is 100 ms or more.

Examples of the liquid permeable recording medium include plain paper, porous paper, and other recording media that are capable of absorbing a liquid.

Examples of the materials of the recording media which are non-permeable or retardant permeable include art paper, synthetic resin, rubber, resin coated paper, glass, metal, ceramic, and wood. In the invention, a composite recording medium composed of some of the above materials in combination can also be used for the purpose of obtaining additional functions.

Any kind of synthetic resins can be used as the synthetic resin, and examples thereof include polyesters such as polyethylene terephthalate and polybutadiene terephthalate, polyolefins such as polyvinyl chloride, polystyrene, polyethylene, polyurethane, and polypropylene, acrylic resins, polycarbonates, acrylonitrile-butadiene-styrene copolymers, diacetate, triacetate, polyimide, cellophane, and celluloid. The thickness and shape of the recording medium when a synthetic resin is used are not particularly limited and the medium may be any shape of film, card and block, and may be either transparent or opaque.

As to the form of usage, the synthetic resin is preferably used in the form of a film for so-called light wrapping, and various non-absorbing plastics and a film thereof can be used. Examples of the plastic films include a PET film, an OPS film, an OPP film, a PNy film, a PVC film, a PE film, a TAC film, and a PP film. Examples of other plastics include polycarbonate resins, acrylic resins, ABS resins, polyacetal resins, PVA resins, and rubbers.

Examples of the resin coated papers include a transparent polyester film, an opaque polyester film, an opaque polyolefin resin film, and a paper support laminated with a polyolefin resin on the both sides thereof A paper support laminated with a polyolefin resin on the both sides thereof is particularly preferable.

The kind of the metals is not particularly limited and preferable examples thereof include aluminum, iron, gold, silver, copper, nickel, titanium, chromium, molybdenum, silicon, lead, zinc, stainless steel, and composite materials thereof.

Further, inkjet recording can be performed on the label side of read-only optical disks such as CD-ROM and DVD-ROM, write-once optical disks such as CD-R and DVD-R, rewritable optical disks and the like.

-Ink and Undercoating Liquid-

The ink and the undercoating liquid used in the inkjet recording method in the invention will be explained in detail hereinafter.

The ink has a composition at least suitable for forming an image. The ink preferably contains at least one of polymerizable materials or crosslinking materials, and if necessary, may contain a polymerization initiator, a lipophilic solvent, a coloring agent, and other components.

The undercoating liquid preferably contains at least one of the specific surfactants, and preferably has a different composition from those of the inks. Further, the undercoating liquid preferably contains at least one of polymerizable materials or crosslinking materials, and if necessary, may contain a polymerization initiator, a lipophilic solvent, a coloring agent, and other components to make a suitable composition.

The polymerization initiator preferably initiates polymerization reaction or crosslinking reaction by being irradiated with an actinic ray. This allows curing of the undercoating liquid applied to the recording medium by irradiation with the actinic ray.

The undercoating liquid preferably contains a radical polymerizable composition. The radical polymerizable composition in the invention contains at least one radical polymerizable material and at least one radical polymerization initiator. By the use of the radical polymerizable composition, the curing reaction of the undercoating liquid can be performed at a high sensitivity in a short period of time.

The ink in the invention is preferably contains a coloring agent. The undercoating liquid to be used in combination with the ink preferably contains no coloring agent; contains a coloring agent in an amount of less than 1% by mass; or contains a white pigment as a coloring agent. Each component constituting each liquid in the above will be described in detail.

(Polymerizable or Crosslinkable Material)

The polymerizable or crosslinkable material in the invention causes polymerization or crosslinking reaction by the action of initiating species such as a radical generated from a polymerization initiator or the like described later, or the like, and has a function to cure a composition containing these components.

Known polymerizable or crosslinkable materials that cause polymerization or crosslinking reaction such as radical polymerization reaction or dimerization reaction can be used as the polymerizable or crosslinkable material. Examples of the polymerizable or crosslinkable materials include an addition polymerizable compound having at least one ethylenically unsaturated double bond, a polymer compound having a maleimide group in the side chain, and a polymer having a group having an unsaturated double bond which is adjacent to an aromatic nucleus and is capable of photo-dimerization, such as a cinnamyl group, a cinnamylidene group, a chalcone group or the like, in a side chain. Among these, an addition polymerizable compound having at least one ethylenically unsaturated double bond is more preferable, and particularly preferably a compound selected from the compounds having at least one and more preferably two or more of terminal ethylenically unsaturated bonds (monofunctional or multifunctional compound). These compounds can appropriately be selected from well known compounds in the industrial field to which the invention is related, and examples thereof, include a compound having a chemical form of a monomer, a prepolymer (i.e., a dimer, a trimer, and an oligomer), a mixture thereof, and a copolymer of these compounds.

The polymerizable or crosslinkable materials may be used alone, or in combination of two or more kinds.

The polymerizable or the crosslinkable material in the invention is particularly preferably various known radical polymerizable monomers that cause a polymerization reaction by initiating species generated from a radical initiator.

Examples of the radical polymerization monomers include (meth)acrylates, (meth)acrylamides, aromatic vinyls, vinyl ethers, and a compound having an inner double bond (maleic acid, etc.). In this case, "(meth)acrylate" refers to both or either one of "acrylate" and "methacrylate," and "(meth) acryl" refers to both or either one of "acryl" and "methacryl."

Specific examples of the (meth)acrylates include the following compounds.

Specific examples of the mono functional (meth)acrylates include hexyl(meth)acrylate, 2-ethylhexyl(meth)acrylate, tert-octyl(meth)acrylate), isoamyl(meth)acrylate, decyl (meth)acrylate, isodecyl(meth)acrylate, stearyl(meth)acrylate, isostearyl(meth)acrylate, cyclohexyl(meth)acrylate, 4-n-butylcyclohexyl(meth)acrylate, bornyl(meth)acrylate, isobornyl(meth)acrylate, benzyl(meth)acrylate, 2-ethylhexyl diglycol(meth)acrylate, butoxyethyl(meth)acrylate, 2-chloroethyl(meth)acrylate, 4-bromobutyl(meth)acrylate, cyanoethyl(meth)acrylate, benzyl(meth)acrylate, butoxymethyl (meth)acrylate, 3-methoxybutyl(meth)acrylate, alkoxymethyl(meth)acrylate, alkoxyethyl(meth)acrylate, 2-(2-methoxyethoxy)ethyl(meth)acrylate, 2-(2-butoxyethoxy)ethyl(meth)acrylate, 2,2,2-trifluoro ethyl(meth)acrylate, 1H,1H,2H,2H-perfluorodecyl(meth)acrylate, 4-butylphenyl(meth)acrylate, phenyl(meth)acrylate, 2,4,5-tetramethylphenyl(meth)acrylate, 4-chlorophenyl(meth) acrylate, phenoxymethyl(meth)acrylate, phenoxyethyl (meth)acrylate, glycidyl(meth)acrylate, glycidyloxybutyl (meth)acrylate, glycidyloxyethyl(meth)acrylate, glycidyloxypropyl(meth)acrylate, tetrahydrofurfuryl(meth) acrylate, hydroxyalkyl(meth)acrylate, 2-hydroxyethyl(meth) acrylate, 3-hydroxypropyl(meth)acrylate, 2-hydroxypropyl(meth)acrylate, 2-hydroxybutyl(meth) acrylate, 4-hydroxybutyl(meth)acrylate, dimethylaminoethyl(meth)acrylate, diethylaminoethyl(meth)acrylate, dimethyaminopropyl(meth)acrylate, diethylaminopropyl(meth) acrylate, trimethoxysilylpropyl(meth)acrylate, trimethylsilylpropyl(meth)acrylate, polyethyleneoxide monomethyether(meth)acrylate, oligoethyleneoxide monomethylether(meth)acrylate, polyethyleneoxide(meth) acrylate, oligoethylenoxide(meth)acrylate, oligoethyleneoxide monoalkylether(meth)acrylate, polyethyleneoxide monoalkylether(meth)acrylate, dipropylene glycol(meth) acrylate, polypropyleneoxide monoalkylether(meth)acrylate, oligopropyleneoxide monoalkylether(meth)acrylate, 2-methacryloyloxyethyl succinic acid, 2-methacryloyloxyhexahydrophthalic acid, 2-methacryloyloxyethyl-2-hydroxypropyl phthalate, butoxydiethylene glycol(meth)acrylate, trifluoroethyl(meth)acrylate, perfluorooctylethyl(meth)acrylate, 2-hydroxy-3-phenoxypropyl(meth)acrylate, EO-modified phenol(meth)acrylate, EO-modified cresol(meth)acrylate, EO-modified nonylphenol(meth)acrylate, PO-modified nonylphenol(meth)acrylate, and EO-modified-2-ethyhexyl (meth)acrylate.

Specific examples of bifunctional (meth)acrylates include 1,6-hexanediol di(meth)acrylate, 1,10-decanediol di(meth) acrylate, neopentylglycol di(meth)acrylate, 2,4-dimethyl-1, 5-pentanediol di(meth)acrylate, butylethylpropanediol (meth)acrylate, ethoxylated cyclohexane methanol di(meth) acrylate, polyethylene glycol di(meth)acrylate, oligoethylene glycol di(meth)acrylate, ethylene glycol di(meth)acrylate, 2-ethyl-2-butyl-butanediol di(meth)acrylate, hydroxypivalic acid neopentyl glycol di(meth)acrylate, EO modified bisphenol A di(meth)acrylate, bisphenol F polyethoxy di(meth) acrylate, dipropylene glycol di(meth)acrylate, polypropylene glycol di(meth)acrylate, oligopropylene glycol di(meth)acrylate, 1,4-butanediol di(meth)acrylate, 2-ethyl-2-butylpropanediol di(meth)acrylate, 1,9-nonane di(meth)acrylate, propoxylated ethoxylated bisphenol A di(meth)acrylate, and tricyclodecane di(meth)acrylate.

Specific examples of trifunctional (meth)acrylates include trimethylolpropane tri(meth)acrylate, trimethylolethane tri (meth)acrylate, rimethylolpropane alkylene oxide-modified tri(meth)acrylate, pentaerythritol tri(meth)acrylate, dipentaerythritol tri(meth)acrylate, trimethylolpropane tris ((meth) acryloyl oxypropyl)ether, isocyanuric acid alkylene oxide-modified tri(meth)acrylate, propionic acid dipentaerythritol tri(meth)acrylate, tris((meth)acryloyl oxyethyl)isocyanurate, hydroxypival aldehyde-modified dimethylolpropane tri (meth)acrylate, sorbitol tri(meth)acrylate, propoxylated trimethylolpropane tri(meth)acrylate, and ethoxylated glycerol triacrylate.

Specific examples of tetrafunctional (meth)acrylates include pentaerythritol tetra(meth)acrylate, sorbitol tetra (meth)acrylate, ditrimethylolpropane tetra(meth)acrylate, propionic acid dipentaerythritol tetra(meth)acrylate, and ethoxylated pentaerythritol tetra(meth)acrylate.

Specific examples of pentafunctional (meth)acrylates include sorbitol penta(meth)acrylate and dipentaerythritol penta(meth)acrylate.

Specific examples of hexafunctional (meth)acrylates include dipentaerythritol hexa(meth)acrylate, sorbitol hexa (meth)acrylate, phosphazene alkylene oxide-modified hexa (meth)acrylate, and caprolactone-modified dipentaerythritol hexa(meth)acrylate.

Examples of the above-described (meth)acrylamides include (meth)acrylamide, N-methyl(meth)acrylamide, N-ethyl(meth)acrylamide, N-propyl(meth)acrylamide, N-N-butyl(meth)acrylamide, N-t-butyl(meth)acrylamide, N-butoxymethyl(meth)acrylamide, N-isopropyl(meth)acrylamide, N-methylol(meth)acrylamide, N,N-dimethyl(meth) acrylamide, N,N-diethyl(meth)acrylamide, and (meth) acryloyl morpholine.

Specific examples of the above-described aromatic vinyls include styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, vinylbenzoic acid methyl ester, 3-methylstyrene, 4-methylstyrene, 43-ethylstyrene, 4-ethylstyrene, 3-propylstyrene, 4-propylstyrene, 3-butylstyrene, 4-butylstyrene, 3-hexylstyrene, 4-hexylstyrene, 3-octylstyrene, 4-octylstyrene, 3-(2-ethylhexyl)styrene, 4-(2-ethylhexyl)styrene, allylstyrene, isopropenylstyrene, butenylstyrene, octenylstyrene, 4-t-butoxycarbonylstyrene, 4-methoxystyrene, and 4-t-butoxystyrene.

Specific examples of the above-described vinyl ethers include monofunctional vinyl ethers such as methyl vinyl ether, ethyl vinyl ether, propyl vinyl ether, N-butyl vinyl ether, t-butyl vinyl ether, 2-ethylhexyl vinyl ether, N-nonyl vinyl ether, lauryl vinyl ether, cyclohexyl vinyl ether, cyclohexyl methyl vinyl ether, 4-methylcyclohexylmethyl vinyl ether, benzyl vinyl ether, dicyclopentenyl vinyl ether, 2-2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, and phenoxypolyethylene glycol vinyl ether.

Examples of the multifunctional vinylethers include divinylethers such as ethylene glycol divinylether, diethylene glycol divinylether, polyethylene glycol divinylether, propylene glycol divinylether, butylene glycol divinylether, hexanediol divinylether, bisphenol A alkyleneoxide divinylether and bisphenol F alkyleneoxide divinylether; and multifunctional vinylethers such as trimethylolethane trivinylether, trimethylolpropane trivinylether, ditrimethylolpropane tetravinylether, glycerin trivinylether, pentaerythritol tetravinylether, dipentaerythritol pentavinylether, dipentaerythritol hexavinylether, ethyleneoxide added trimethylolpropane trivinylether, propyleneoxide added trimethylolpropane trivinylether, ethyleneoxide added ditrimethylolpropane tetravinylether, propyleneoxide added ditrymethylolpropane tetravinylether, ethyleneoxide added pentaerythritol tetravinylether, propyleneoxide added pentaerythritol tetravinylether, ethyleneoxide added dipentaerythritol hexavinylether, and propyleneoxide added dipentaerythritol hexavinylether.

The vinylether compound is preferably a di- or tri-vinylether compound from the viewpoint of curing property, adhesiveness to a recording medium, surface hardness of the formed image or the like, and is particularly preferably a divinylether compound.

Other examples of the radical polymerizable monomers in the invention include vinylesters such as vinyl acetate, vinyl propionate and vinyl versatate; allylesters such as allyl acetates; halogen-containing monomers such as vinylidene chloride and vinyl chloride; vinyl cyanides such as (metha) acrylonitrile; and olefins such as ethylene and propylene.

Among the above, the radical polymerizable monomer is preferably a (metha)acrylate and (metha)acrylamides in view of curing speed, and particularly preferably a (metha)acrylate of tetrafunctional or more in view of curing speed. From the viewpoint of the viscosity of the ink composition, it is preferable to use a multifunctional (metha)acrylate in combination with a mono functional or bifunctional (metha)acrylate or (metha)acrylamide.

The content of the polymerizable or crosslinkable material in the ink and the undercoating liquid is preferably in the range of from 50 to 99.6% by mass with respect to the total solid content (mass) in each liquid droplet, more preferably in the range of from 70 to 99.0% by mass, and further preferably in the range of from 80 to 99.0% by mass.

The content of the polymerizable or crosslinkable material in the liquid droplet is preferably in the range of from 20 to 98% by mass with respect to the total mass of each liquid droplet, more preferably in the range of from 40 to 95% by mass, and particularly preferably in the range of from 50 to 90% by mass.

(Polymerization Initiator)

The ink and the undercoating liquid can be preferably formed by use of at least one polymerization initiator, and it is preferable that at least the undercoating liquid contains the polymerization initiator. This polymerization initiator is a compound that generates initiating species such as a radical generated by being irradiated with actinic light, by being heated, or both of light and heat, and allow to initiate and accelerate the reaction with the polymerization or crosslinking reaction of the above-described polymerizable or crosslinkable materials to be cures.

From the aspect of the polymerizability, the polymerization initiator preferably causes a radical polymerization, and is particularly preferably a photopolymerization initiator.

The photopolymerization initiator is a compound that causes a chemical change by the action of light and an interaction with a sensitizing dye in an electronically excited state and produces at least any one of a radical, acid and base, and a photoradical generator is preferable from the viewpoint that the polymerization can simply be initiated by means of exposure.

The photopolymerization initiator in the invention can be selected from the photopolymerization initiators sensitive to actinic light such as an ultraviolet ray of from 400 to 200 nm, far ultraviolet ray, g-ray, h-ray, i-ray, KrF excimer laser beam, ArF excimer laser beam, electron beam, X-ray, molecular beam or an ion beam.

Specifically, known photopolymerization initiators in the art can be used limitation, such as the ones described in Bruce M. Monroe et al., *Chemical Reviews,* 93, 435 (1993); R. S. Davidson, *Journal of Photochemistry and Biology A: Chemistry,* 73.81 (1993); J. P. Faussier, "Photoinitiated Polymerization—Theory and Applications", *Rapra Review Report*, vol. 9, Rapra Technology (1998); and M. Tsunooka et al., *Prog. Polym. Sci.,* 21, 1 (1996). Further, a group of compounds that oxidatively or reductively generates a bond cleavage through interaction with a sensitizing dye in an electronically excited state as described in F. D. Saeva, *Topics in Current Chemistry,* 156, 59 (1990); G. G Maslak, *Topics in Current Chemistry,* 168, 1 (1993); H. B. Shuster et al., *JACS,* 112, 6329 (1990); I. D. F. Eaton et al., *JACS,* 102, 3298 (1980), and the like.

Preferable photopolymerization initiators can be exemplified by: (a) aromatic ketones; (b) aromatic onium salt compounds; (c) organic peroxides; (d) hexaarylbiimidazole compounds; (e) ketoxime ester compounds; (f) borate compounds; (g) azinium compounds; (h) metallocene compounds; (i) active ester compounds; and (j) compounds having a carbon-halogen bond.

Preferable examples of the (a) aromatic ketones include a compound having a benzophenone skeleton or a thioxanthone skeleton described in J. P. Fouassier, J. F. Rabek, "Radiation Curing in Polymer Science and Technology", pp. 77-117 (1993). More preferable examples of the (a) aromatic ketones include α-thiobenzophenone compounds described in Japanese Patent Publication (JP-B) No. 47-6416, benzoin ether compounds described in JP-B No. 47-3981, α-substituted benzoin compounds described in JP-B No. 47-22326, benzoin derivatives described in JP-B No. 47-23664, aroylphosphonic esters described in JP-A No. 57-30704, dialkoxybenzophenone described in JP-B No. 60-26483, benzoinethers described in JP-B No. 60-26403 and JP-B No. 62-81345, α-aminobenzophenones described in JP-B No. 1-34242, U.S. Pat. No. 4,318,791 and EP No. 0284561A1, p-di(dimethylaminozenzoyl)benzene described in JP-A No. 2-211452, thio-substituted aromatic ketones described in JP-A No. 61-194062, acylphosphine sulfides described in JP-B No. 2-9597, acylphosphines described in JP-B No. 2-9596, thioxantones described in JP-B No. 63-61950, and coumarins described in JP-B No. 59-42864.

Examples of the (b) aromatic onium salt compounds include aromatic omium salts of the elements in the groups of V, VI, and VII in the periodic table, specifically N, P, As, Sb, Bi, O, S, Se, Te or I. Preferable examples thereof include iodonium salts described in EP No. 104143, U.S. Pat. No. 4,837,124, JP-A No. 2-150848 and JP-A No. 2-96514; sulfonium salts described in EP Nos. 370693, 233567, 297443, 297442, 279210 and 422570, U.S. Pat. Nos. 3,902,144, 4,933,377, 4,760,013, 4,734,444 and 2,833,827; diazonium salts (such as benzene diazoniums that may have a substituent); diazonium salt resins (such as formaldehyde resins of diazophenylamine); N-alkoxypyridium salts (examples thereof include compounds described in U.S. Pat. No. 4,743,528, JP-A Nos. 63-138345, 63-142345, 63-142346 and JP-B No. 46-42363; and specific examples thereof include 1-methoxy-4-phenylpyridium and tetrafluoroborate), and compounds described in JP-B Nos. 52-147277, 52-14278 and 52-14279. Radicals and acids are produced as the active species.

Examples of the (c) "organic peroxides" includes almost all of the organic compounds having one or more oxygen-oxygen bonds in the molecule and can be exemplified by ester peroxide type compounds such as 3,3',4,4'-tetrakis(t-butylperoxycarbonyl)benzophenone, 3,3',4,4'-tetrakis(t-amylperoxycarbonyl)benzophenone, 3,3',4,4'-tetrakis(t-hexylperoxycarbonyl)benzophenone, 3,3',4,4'-tetrakis(t-octylperoxylcarbonyl)benzophenone, 3,3',4,4'-tetrakis(cumylperoxycarbonyl)benzophenone, 3,3',4,4'-tetrakis(p-isopropylcumylperoxycarbonyl)benzophenone, and di-t-butyldiperoxyisophthalate.

Examples of the (d) hexaarylbiimidazoles include the lophin dimers described in JP-B Nos. 45-37377 and 44-86516 such as 2,2'-bis(o-chlorophenyl)-4,4',5,5'-tetraphenylbiimidazole, 2,2'-bis(o-bromophenyl)-4,4',5,5'-tetraphenylbiimidazole, 2,2'-bis(o,p-dichlorophenyl)-4,4',5,5'-tetraphenylbiimidazole, 2,2'-bis(o-chlorophenyl)-4,4',5,5'-tetrakis(m-methoxyphenyl)biimidazole, 2,2'-bis(o,o'-dichlorophenyl)-4,4',5,5'-tetraphenylbiimidazole, 2,2'-bis(o-nitrophenyl)-4,4',5,5'-tetraphenylbiimidazole, 2,2'-bis(o-methylphenyl)-4,4',5,5'-tetraphenylbiimidazole, and 2,2'-bis(o-trifluorophenyl)-4,4',5,5'-tetraphenylbiimidazole.

Examples of the (e) ketoxime esters include 3-benzoyloxyiminobutane-2-one, 3-acetoxyimonobutane-2-one, 3-propionyloxyiminobutane-2-one, 2-acetoxyiminopentane-3-one, 2-acetoxyimino-1-phenylpropane-1-one, 2-benzoyloxyimino-1-phenylpropane-1-one, 3-p-toluenesulfonyloxyiminobutane-2-one, and 2-ethoxycarbonyloxyimino-1-phenylpropane-1-one.

Examples of the (f) borate compounds include the compounds described in U.S. Pat. Nos. 3,567,453 and 4,343,891, and EP Nos. 109,772 and 109,773.

Examples of the (g) azinium compounds are include the compounds having a N—O bond described in JP-A Nos. 63-138345, 63-142345, No. 63-142346 and 63-143537, and JP-B No. 46-42363.

Examples of the (h) metallocene compounds include the titanosen compounds described in JP-A Nos. 59-152396, 61-151197, 63-41484, 2-249, and 2-4705; and the iron-arene complexes described in JP-A Nos. 1-304453 and 1-152109.

Specific examples of the titanosen compounds include di-cyclopentadienyl-Ti-di-chloride, di-cyclopentadienyl-Ti-bis-phenyl, di-cyclopentadienyl-Ti-bis-2,3,4,5,6-pentafluoropheny-1-yl, di-cyclopentadienyl-Ti-bis-2,3,5,6-tetrafluoropheny-1-yl, di-cyclopentadienyl-Ti-bis-2,4,6-trifluoropheny-1-yl, di-cyclopentadienyl-Ti-2,6-difluoropheny-1-yl, di-cyclopentadienyl-Ti-bis-2,4-difluoropheny-1-yl, di-methylcyclopentadienyl-Ti-bis-2,3,4,5,6-pentafluoropheny-1-yl, di-methylcyclopentadienyl-Ti-bis-2,3,5,6-tetrafluoropheny-1-yl, di-methylcyclopentadienyl-Ti-bis-2,4-difluoropheny-1-yl, bis(cyclopentadienyl)-bis(2,6-difluoro-3-(pyri-1-yl)phenyl) titanium, bis(cyclopentadienyl)bis[2,6-difluoro-3-(methylsulfoneamide)phenyl]titanium, and bis(cyclopentadienyl)bis[2,6-difluoro-3-(N-butylbiaroyl-amino)phenyl]titanium.

Examples of the (i) active ester compounds include the nitrobenzylester compounds described in EP Nos. 0290750, 046083, 156153, 271851 and 0388343, U.S. Pat. Nos. 3,901,710 and 4,181,531, JP-A Nos. 60-198538 and 53-133022; iminosulfonate compounds described in EP Nos. 0199672, 84515, 044115 and 0101122, U.S. Pat. Nos. 4,618,564, 4,371,605 and 4,431,774, JP-A Nos. 64-18143, 2-245756 and 4-365048; and the compounds described in JP-B No. 62-6223, JP-B No. 63-14340, and JP-A No. 59-174831.

Preferable examples of the (j) compounds having a carbon-halogen bond include the compounds described in Wakabayashi et al., *Bull. Chem. Soc. Japan,* 42, 2924 (1969), compounds described in U.K. Patent No. 1388492, compounds described in JP-A No. 53-133428, and the compounds described in German Patent No. 3337024.

Further, preferable examples of the compounds also include the compounds described in F. C. Schaefer et al., *J. Org. Chem.,*. 29, 1527 (1964), compounds described in JP-A Nos. 62-58241 and 5-281728, compounds described in German Patent Nos. 2641100 and 3333450, and the compounds described in German Patent Nos. 3021590 and 3021599.

Examples of the photopolymerization initiator in the invention may be the compounds as shown below, but are not limited thereto.

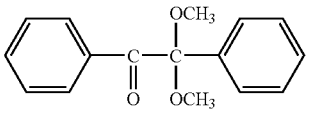

-continued
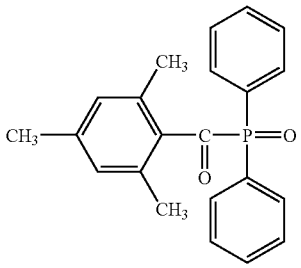
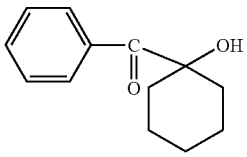
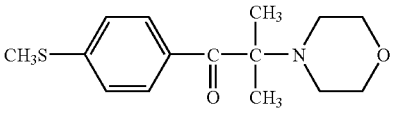
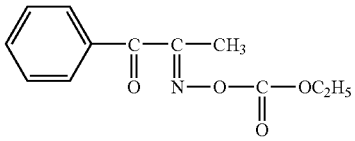
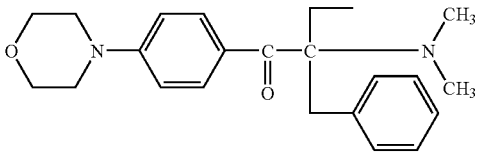
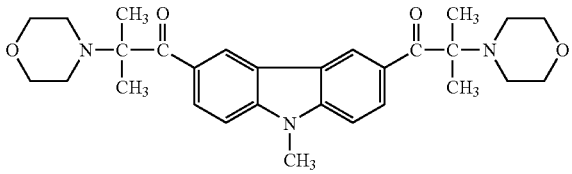
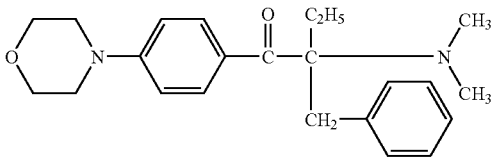
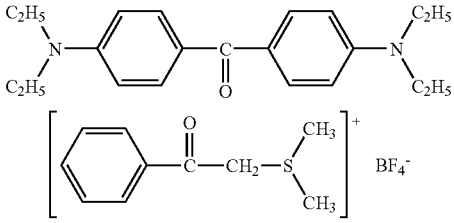
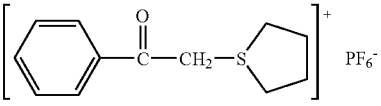
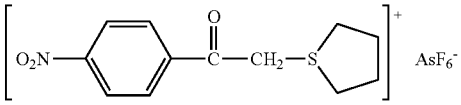
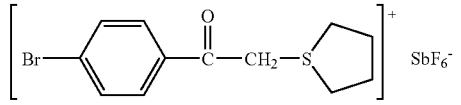
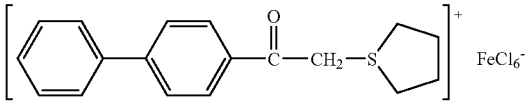
-continued
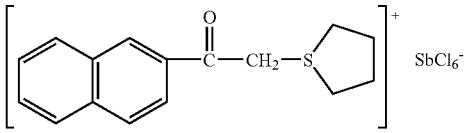
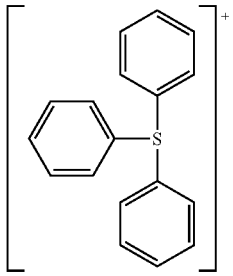
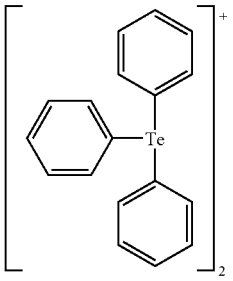
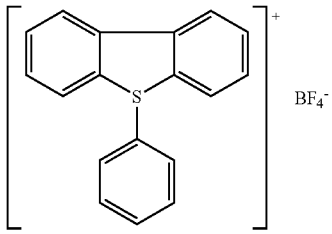
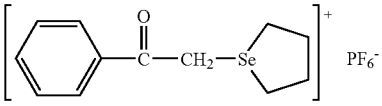
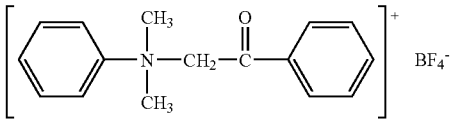
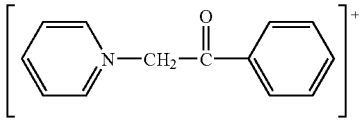
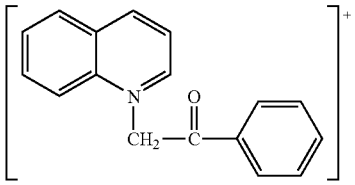
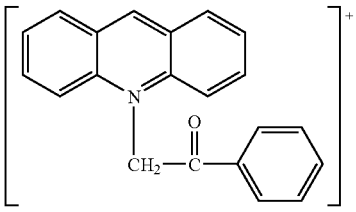

-continued
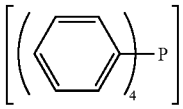
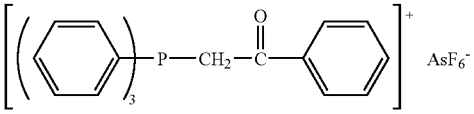
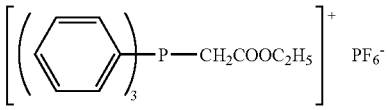
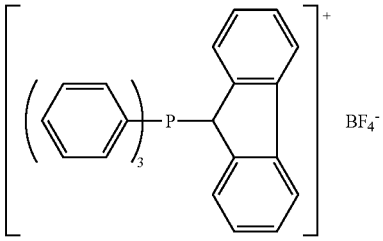
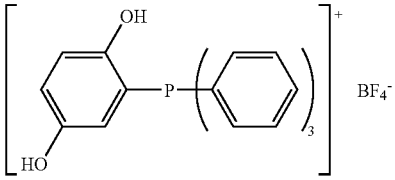
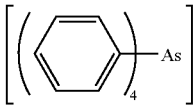
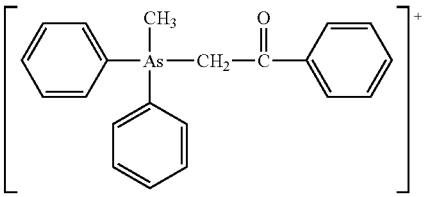
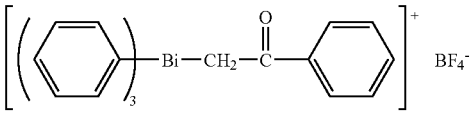
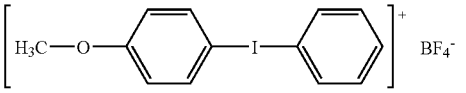
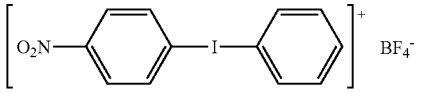
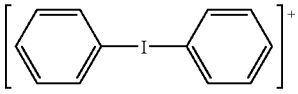
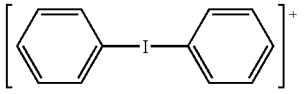
-continued
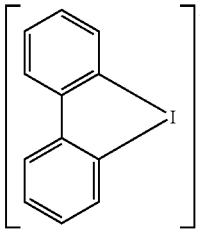
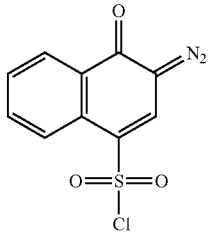
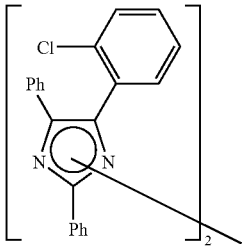
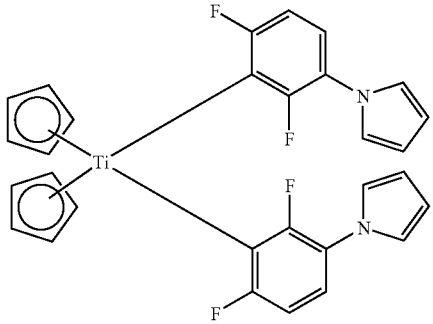
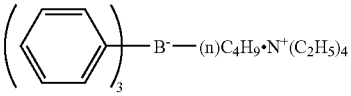
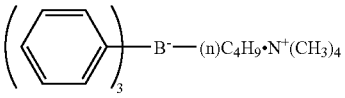
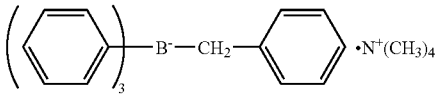
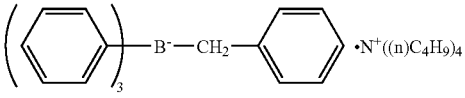
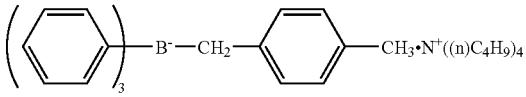
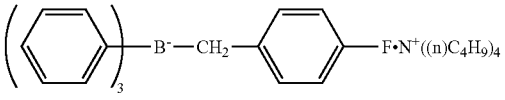
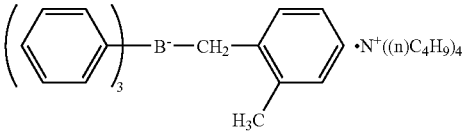
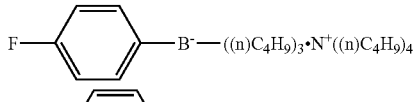
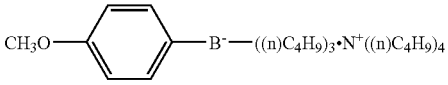

-continued

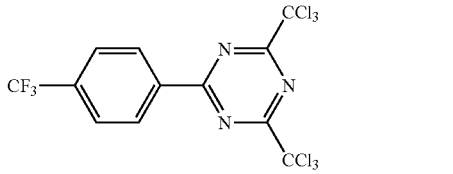

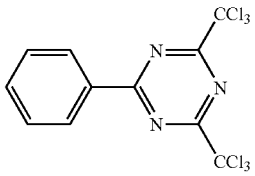

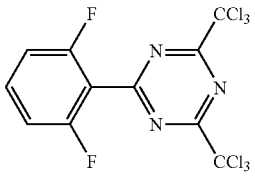

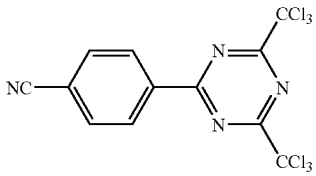

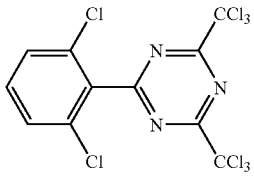

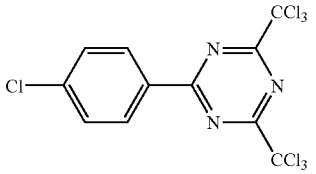

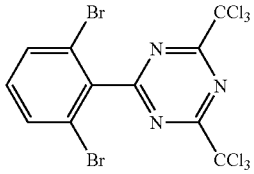

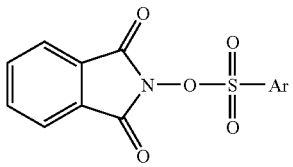

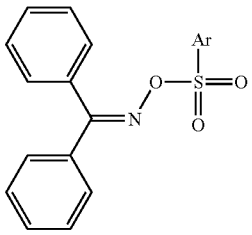

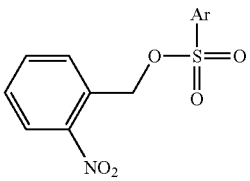

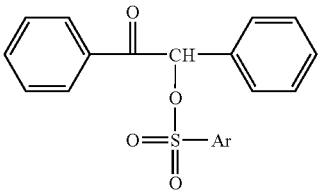

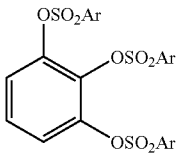

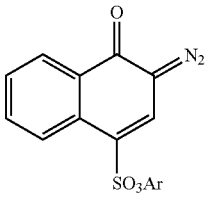

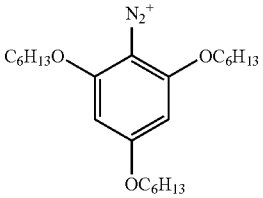

-continued

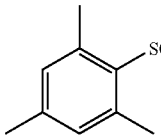

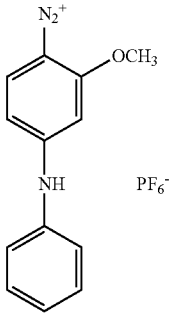

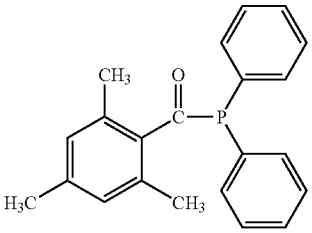

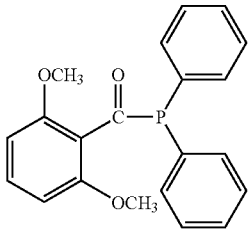

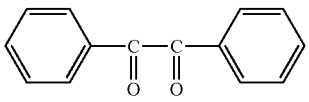

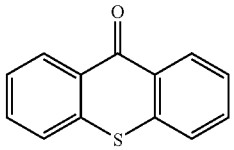

The polymerization initiator preferably has a high sensitivity. However, from the viewpoint of storage stability, the polymerization initiator that does not cause thermal decomposition at a temperature up to 80° C. is preferably selected.

The polymerization initiator may be used alone or in combination of two or more kinds. Known sensitizers may be also used in combination for the purpose of improving the sensitivity as long as the effect of invention is not impaired.

The content of the polymerization initiator in the undercoating liquid is preferably in the range of from 0.5 to 20% by mass with respect to the amount of the polymerizable material contained in the undercoating liquid, more preferably from 1 to 15% by mass, and particularly preferably from 3 to 10% by mass, from the viewpoint of stability over time, curing property and curing speed. The content of the polymerization initiator is in the above range, so that occurrence of precipitation or separation with the lapse of time and deterioration in the performances such as ink strength or rubbing resistance after curing can be suppressed.

The polymerization initiator may be contained in the ink as well as in the undercoating liquid, and the content thereof can be appropriately determined in the range where the storage stability of the ink can be maintained at the desired level. The content of the polymerization initiator in the ink droplet is preferably from 0.5 to 20% by mass with respect to the polymerizable or crosslinkable compound in the ink, and more preferably from 1 to 15% by mass.

(Sensitizing Dye)

A sensitizing dye may be added for the purpose of enhancing the sensitivity of the photopolymerization initiator in the invention. Preferred examples of the sensitizing dyes are the compounds included in the following compounds below and have an absorption wavelength in the range of from 350 nm to 450 nm.

Polynuclear aromatics (for example, pyrene, perylene, and triphenylene), xanthenes (for example, fluorescein, eosin, erythrosine, rhodamine B, and rose bengal), cyanines (for example, thiacarbocyanine and oxacarbocyanine), merocyanines (for example, merocyanine and carbomerocyanine), thiazines (for example, thionine, methylene blue, and toluyzine blue), acridines (for examples, acridine orange, chloroflavin, and acriflavin), anthraquinones (for example, anthraquinone), squaryliums (for example, squarylium), and cumarins (for example, 7-diethylamino-4-methylcumarin).

Examples of the preferred sensitizing dyes are the compounds represented by the following Formulas (IX) to (XIII).

(IX)

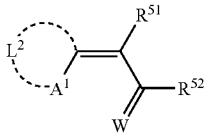

(X)

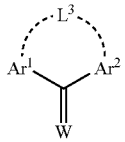

(XI)

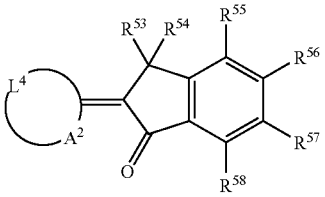

(XII)

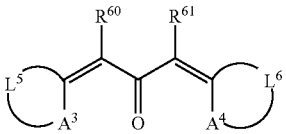

(XIII)

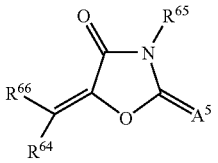

In Formula (IX), $A^1$ represents a sulfur atom or —$NR^{50}$—, $R^{50}$ represents an alkyl group or an aryl group, $L^2$ represents a non-metal atomic group that forms a basic nucleus of a dye together with the adjacent $A^1$ and the adjacent carbon atom, $R^{51}$ and $R^{52}$ each independently represent a hydrogen atom or a monovalent non-metal atomic group, wherein $R^{51}$ and $R^{52}$ may form an acid nucleus of a dye by bonding to each other. W represents an oxygen atom or a sulfur atom.

In Formula (X), $Ar^1$ and $Ar^2$ each independently represent an aryl group, and connect with each other via a bond by -$L^3$-, wherein $L^3$ represents —O— or —S—. W represents an oxygen atom or a sulfur atom.

In Formula (XI), $A^2$ represents a sulfur atom or —$NR^{59}$—, $L^4$ represents a non-metal atomic group that forms a basic nucleus of a dye together with the adjacent $A^2$ and the carbon atom. $R^{53}$, $R^{54}$, $R^{55}$, $R^{56}$, $R^{57}$, and $R^{58}$ each independently represent a group of a monovalent non-metal atomic group, and $R^{59}$ represents an alkyl group or an aryl group.

In Formula (XII), $A^3$ and $A^4$ each independently represent —S—, —$NR^{62}$—, or —$NR^{63}$—, $R^{62}$ and $R^{63}$ each independently represent a substituted or unsubstituted alkyl group or a substituted or unsubstituted aryl group, $L^5$ and $L^6$ each independently represent a non-metal atomic group that forms a basic nucleus of a dye together with the adjacent $A^3$, $A^4$, and the adjacent carbon atom, and $R^{60}$ and $R^{61}$ each independently represent a hydrogen atom or a monovalent non-metal atomic group, or can form an aliphatic or aromatic ring by bonding to each other.

In Formula (XIII), $R^{66}$ represents an aromatic ring or a hetero ring that may have a substituent, and $A^5$ represents an oxygen atom, a sulfur atom, or —$NR^{67}$—. $R^{64}$, $R^{65}$, and $R^{67}$ each independently represent a hydrogen atom or a monovalent non-metal atomic group, and $R^{67}$ and $R^{64}$, and $R^{65}$ and $R^{67}$ can bond to each other to form an aliphatic or an aromatic ring.

Specific examples of the compounds represented with the Formulas (IX) to (XIII) include Exemplified Compounds (A-1) to (A-20) shown as follows.

(A-1)

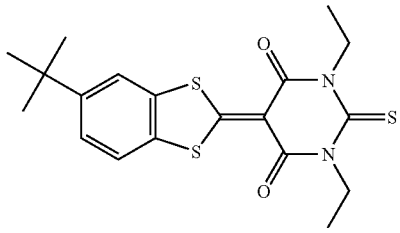

(A-2)

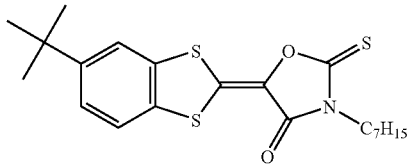

(A-3)

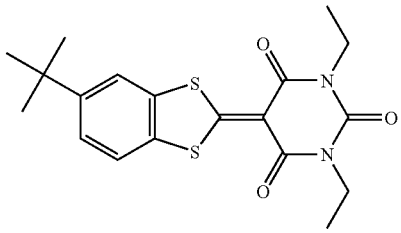

(A-4)

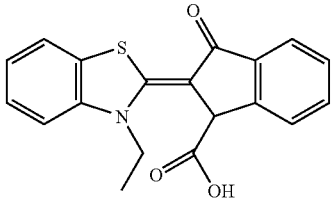

(A-5)

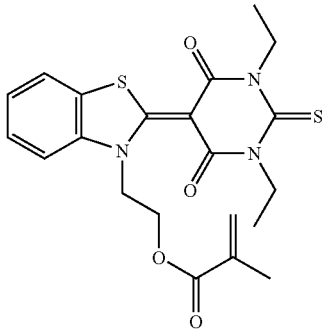

-continued (A-6)

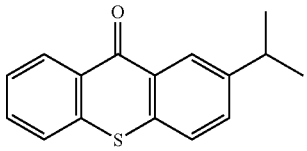

(A-7)

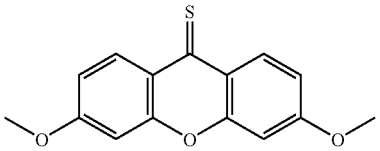

(A-8)

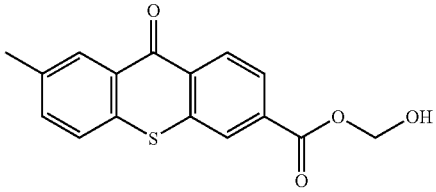

(A-9)

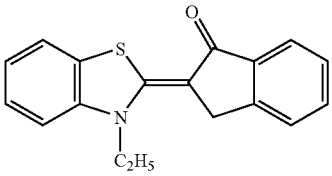

(A-10)

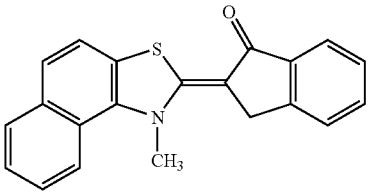

(A-11)

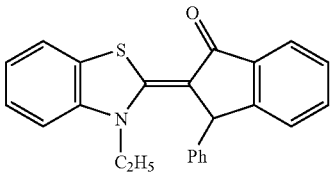

(A-12)

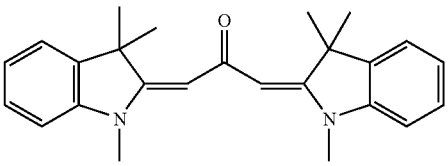

(A-13)

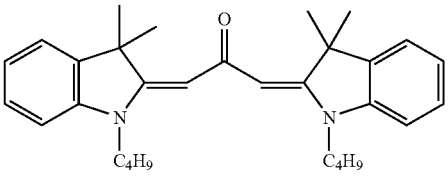

(A-14)

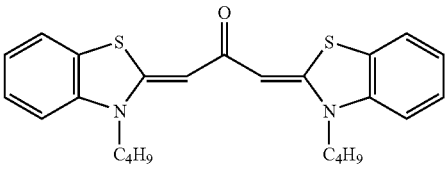

-continued (A-15)

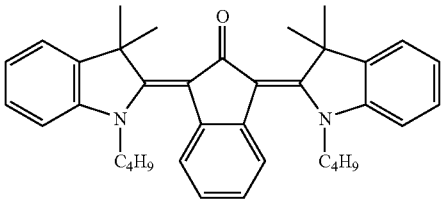

(A-16)

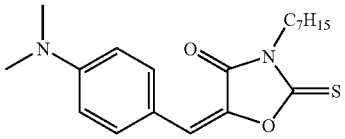

(A-17)

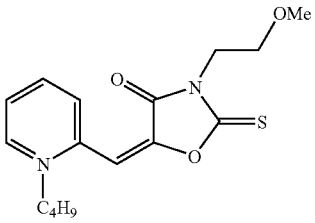

(A-18)

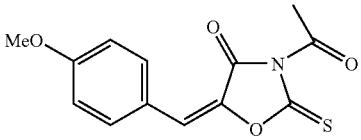

(A-19)

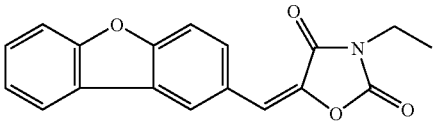

(A-20)

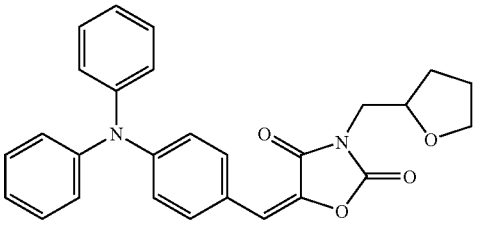

(Cosensitizer)

Known compounds having the ability to further improve sensitivity or suppress the inhibition of polymerization by oxygen may be added as a cosensitizer.

Examples of the cosensitizers include amines such as the compounds described in M. R. Sander et al., *Journal of Polymer Society*, vol. 10, 3173 (1972), JP-B No. 44-20189, JP-A Nos. 51-82102, 52-134692, 59-138205, 60-84305, 62-18537 and 64-33104, and *Research Disclosure* No. 33825. Specific compounds thereof include triethanolamine, p-dimethylaminobenzenethylester, p-formyldimethyaniline, and p-methylthiodimethylaniline.

Other examples of the cosensitizers include thiols and sulfides such as the thiol compounds described in JP-A No. 53-702, JP-B No. 55-500806, and JP-A No. 5-142772, and the disulfide compounds described in JP-A No. 56-75643. Specific examples thereof include 2-mercaptobenzothiazole, 2-mercaptobenzoxazole, 2-mercaptobenzoimidazole, 2-mercapto-4-(3H)-quinazoline, and β-mercaptonaphthalene.

Other examples of the cosensitizers further include amino acid compounds (for example, N-phenylglycine), the organic metal compounds described in JP-B No. 48-42965 (for example, tributyl tin acetate), the hydrogen donors described in JP-B No. 55-34414, the sulfur compounds described in JP-A No. 6-308727 (for example, trithiane), the phosphor compounds described in JP-A No. 6-250387 (for example, diethylphosphite), and the compounds of Si—H and Ge—H described in JP-A No. 8-65779.

(Coloring Agent)

The ink and the undercoating liquid preferably contain at least one coloring agent, and more preferably a coloring agent is contained at least in the ink. The coloring agent may be included in the undercoating liquid and other liquids other than the ink.

The coloring agent is not particularly limited, and may be appropriately selected from known water-soluble dyes, oil-soluble dyes, and pigments. The ink and the undercoating liquid in the invention are preferably composed as a non-water soluble organic solvent system from the viewpoint of the effect of the invention, and oil-soluble dyes or pigments that readily dissolve or uniformly disperse in a non-water soluble medium are preferably used.

The content of the coloring agent in the ink is preferably from 1 to 30% by mass, more preferably from 1.5 to 25% by mass, and particularly preferably from 2 to 15% by mass. When the undercoating liquid contains a white pigment, the content thereof in the undercoating liquid is preferably from 2 to 45% by mass, and more preferably from 4 to 35% by mass.

Details of the pigments will be explained focusing on the preferable examples thereof in the invention.

(Pigment)

In the invention, it is preferable that a pigment is used as the coloring agent. Either of organic pigments and inorganic pigments can be used as the pigment. Carbon black pigment can be exemplified as a preferable black pigment. The pigments of black and the three primary colors of cyan, magenta, and yellow are generally used, but pigments having other hues such as red, green, blue, brown and white, metallic-glossy pigments such as gold and silver, and colorless or a light color extenders can also be used depending on the purpose.

Examples of the organic pigments are not limited by the hues thereof, and include the pigments of perylene, perynone, quinacridone, quinacridone quinone, anthraquinone, anthoanthrone, benzimidazolone, disazo condensation, disazo, azo, indanthrone, phthalocyanine, triarylcarbonium, dioxadine, aminoanthraquinone, diketopyrrolopyrrole, thio indigo, isoindoline, isoindolinone, pyranthrone and isoviolanthrone, and mixtures thereof.

Further specific examples of the pigments include perylene-based pigments such as C. I. Pigment Red 190 (C. I. No. 71140), C. I. Pigment Red 224 (C. I. No. 71127), and C. I. Pigment Violet 29 (C. I. No. 71129); perynone-based pigments such as C. I. Pigment Orange 43 (C. I. No. 71105) and C. I. Pigment Red 194 (C. I. No. 71100); quinacridone-based pigments such as C. I. Pigment Violet 19 (C. I. No. 73900), C. I. Pigment Violet 42, C. I. Pigment Red 122 (C. I. No. 73915), C. I. Pigment Red 192, C. I. Pigment Red 202 (C. I. No. 73907), C. I. Pigment Red 207 (C. I. No. 73900 and No. 73906), and C. I. Pigment Red 209 (C. I. No. 73905); quinacridone quinone-based pigments such as C. I. Pigment Red 206 (C. I. No. 73900/73920), C. I. Pigment Orange 48 (C. I. No. 73900/73920), and C. I. Pigment Orange 49 (C. I. No. 73900/73920); anthraquinone-based pigments such as C. I. Pigment Yellow 147 (C. I. No. 60645); anthoanthrone-based pigments such as C. I. Pigment Red 168 (C. I. No. 59300); benzimidazolone-based pigments such as C. I. Pigment Brown 25 (C. I. No. 12510), C. I. Pigment Violet 32 (C. I. No. 12517), C. I. Pigment Yellow 180 (C. I. No. 21290), C. I. Pigment Yellow 181 (C. I. No. 11777), C. I. Pigment Orange 62 (C. I. No. 11775), and C. I. Pigment Red 185 (C. I. No. 12516); disazo condensation-based pigments such as C. I. Pigment Yellow 93 (C. I. No. 20710), C. I. Pigment Yellow 94 (C. I. No. 20038), C. I. Pigment Yellow 95 (C. I. No. 20034), C. I. Pigment yellow 128 (C. I. No. 20037), C. I. Pigment Yellow 166 (C. I. No. 20035), C. I. Pigment Orange 34 (C. I. No. 21115), C. I. Pigment Orange 13 (C. I. No. 21110), C. I. Pigment Orange 31 (C. I. No. 20050), C. I. Pigment Red 144 (C. I. No. 20735), C. I. Pigment Red 166 (C. I. No. 20730), C. I. Pigment Red 220 (C. I. No. 20055), C. I. Pigment Red 221 (C. I. No. 20065), C. I. Pigment Red 242 (C. I. No. 20067), C. I. Pigment Red 248, C. I. Pigment Red 262, and C. I. Pigment Brown 23 (C. I. No. 20060);

Disazo-based pigments such as C. I. Pigment Yellow 13 (C. I. No. 21100), C. I. Pigment Yellow 83 (C. I. No. 21108), and C. I. Pigment Yellow 188 (C. I. No. 21094); azo-based pigments such as C. I. Pigment Red 187 (C. I. No. 12486), C. I. Pigment Red 170 (C. I. No. 12475), C. I. Pigment Yellow 74 (C. I. No. 11714), C. I. Pigment Yellow 150 (C. I. No. 48545), C. I. Pigment Red 48 (C. I. No. 15865), C. I. Pigment Red 53 (C. I. No. 15585), C. I. Pigment Orange 64 (C. I. No. 12760), and C. I. Pigment Red 247 (C. I. No. 15915); indanthrone-based pigments such as C. I. Pigment Blue 60 (C. I. No. 69800); phthalocyanine-based pigments such as C. I. Pigment Green 7 (C. I. No. 74260), C. I. Pigment Green 36 (C. I. No. 74265), C. I. Pigment Green 37 (C. I. No. 74255), C. I. Pigment Blue 16 (C. I. No. 74100), C. I. Pigment Blue 75 (C. I. No. 74160: 2), and 15 (C. I. No. 74160); triarylcarbonium-based pigments such as C. I. Pigment Blue 56 (C. I. No. 42800) and C. I. Pigment Blue 61 (C. I. No. 42765: 1); dioxadine-based pigments such as C. I. Pigment Violet 23 (C. I. No. 51319) and C. I. Pigment Violet 37 (C. I. No. 51345); aminoanthraquinone-based pigments such as C. I. Pigment Red 177 (C. I. No. 65300); diketopyrrolopyrrole-based pigments such as C. I. Pigment Red 254 (C. I. No. 56110), C. I. Pigment 255 (C. I. No. 561050), C. I. Pigment Red 264, C. I. Pigment Red 272 (C. I. No. 561150), C. I. Pigment Orange 71, and C. I. Pigment Orange 73; thio indigo-based pigments such as C. I. Pigment Red 88 (C. I. No. 73312); isoindoline-based pigments such as C. I. Pigment Yellow 139 (C. I. No. 56298) and C. I. Pigment Orange 66 (C. I. No. 48210); isoindolinone-based pigments such as C. I. Pigment Yellow 109 (C. I. No. 56284) and C. I. Pigment Orange 61 (C. I. No. 11295); pyranthrone-based pigments such as C. I. Pigment Orange 40 (C. I. No. 59700) and C. I. Pigment Red 216 (C. I. No. 59710); and isoviolanthrone-based pigments such as C. I. Pigment Violet 31 (60010).

In the invention, two or more kinds of the organic pigments or solid solutions of the organic pigments can be combined and used.

Particles having a core material such as silica, alumina, resin having a dye or a pigment fixed on the surface of the particles, an insoluble laked compound of a dye, colored emulsion and colored latex can also be used as the pigment. Further, a pigment coated with a resin can also be used, which is called a micro capsule pigment and the products thereof are commercially available from DAINIPPON INK AND CHEMICALS, INC., TOKYO INK MFG CO., LTD. and the like.

The volume average particle diameter of the pigment particles contained in the liquid is preferably in the range of from 10 to 250 nm, in light of the balance between optical density and storage stability, and further preferably from 50 to 200 nm. The volume average particle diameter of the pigment particles can be measured by a particle diameter distribution analyzer such as LB-500 (manufactured by HORIBA, LTD.).

The coloring agents may be used alone or in the form of a mixture of two or more kinds thereof Further, different coloring agents may be used in different liquid droplets to be ejected and liquids, or the same coloring agent may be used therein.

(Other Components)

Components other than the ones described above such as known additives can also be used as appropriate depending on the purpose.

<Storage Stabilizer>

A storage stabilizer can be added in the ink and the undercoating liquid according to the invention (preferably in the ink) for the purpose of suppressing undesired polymerization during storage. The storage stabilizer is preferably used together with the polymerizable or crosslinkable material, and is preferably soluble in the liquid droplets or liquid or other coexistent components in which the storage stabilizer is contained.

Examples of the storage stabilizers include a quaternary ammonium salt, hydroxylamines, cyclic amides, nitriles, substituted ureas, heterocyclic compounds, organic acids, hydroquinone, hydroquinone monoethers, organic phosphines and copper compounds, and specific examples thereof include benzyltrimethylammonium chloride, diethylhydroxylamine, benzothiazole, 4-amino-2,2,6,6-tetramethylpiperizine, citric acid, hydroquinone monomethyether, hydroquinone monobutylether and copper naphthenate.

The addition amount of the storage stabilizer is preferably adjusted as appropriate according to the activity of the polymerization initiator, polymerization property of the polymerizable or crosslinkable material, or the type of the storage stabilizer, but is preferably from 0.005 to 1% by mass in terms of the solid content, more preferably from 0.01 to 0.5% by mass, and further preferably 0.01 to 0.2% by mass, in view of the balance between storage stability and curing property.

<Electroconductive Salts>

Electroconductive salts are solid compounds that enhance electroconductivity. In the invention, it is preferable that the electroconductive salt is not substantially used since there is a fear depositing of the salts during storage, but appropriate amount thereof may be added when the solubility of the electroconductive salt is enhanced or a substance enhancing solubility in the liquid component is used, to give a high solubility.

Examples of the electroconductive salts include potassium thiocyanate, lithium nitrate, ammonium thiocyanate and dimethylamine hydrochloride.

<Solvent>

Known solvents can be used in the invention, if necessary. The solvent can be used for the purpose of improving the polarity, viscosity or the surface tension of the liquid (ink), improving the solubility or dispersibility of the coloring agent, adjustment of the conductivity, or the printing performance.

The solvent in the invention is preferably a non-water soluble liquid that does not contain an aqueous solvent, from the viewpoint of recording a high quality image having a fast drying property and uniform line width. Therefore, the solvent is preferably composed of a high boiling point organic solvent.

The high boiling point organic solvent used in the invention preferably has an excellent compatibility with the constituent materials, especially with the monomers.

Preferable examples of the solvents include tripropylene glycol monomethyether, dipropylene glycol monomethylether, propylene glycol monomethylether, ethylene glycol monobutylether, diethylene glycol monobutylether, triethylene glycol monobutylether, ethylene glycol monobenzylether and diethylene glycol monobenzylether.

Although known low boiling point organic solvents having a boiling point of 100° C. or less are exemplified, it is preferable to avoid to use such solvents in consideration of unfavorable effects on the curing ability and the possibility of causing environmental pollution. In the case of using these solvents, it is preferable to select a solvent with high safety, i.e., a solvent with high control concentration (the index indicated according to the working environment evaluation standard), which is preferably 100 ppm or more and further preferably 200 ppm or more. Examples of such solvents include alcohols, ketones, esters, ethers and hydrocarbons, and specifically include methanol, 2-butanol, acetone, methylethylketone, ethyl acetate, and tetrahydrofuran.

The solvent can be used alone or in combination of two or more kinds. However, when water and/or a low boiling point organic solvent are used, the total amount thereof in each liquid is preferably from 0 to 20% by mass, more preferably from 0 to 10% by mass, and it is further preferable that they are substantially not contained. It is preferable that the ink and the undercoating liquid of the invention substantially does not contain water from the viewpoint of maintaining stability with the lapse of time without an increase in the turbidity of the liquid attributable to occurrence of heterogeneity and precipitation of a dye and the like, and from the viewpoint of securing the drying property when an impermeable or low permeable recording medium is used. The term "substantially does not contain" here means that a permissible level of inevitable impurities may exist.

<Other Additives>

Known additives such as a polymer, an ultraviolet absorber, an antioxidant, an anti-fading agent, and a pH regulator can be used in combination.

Known compounds may be appropriately selected and used as the above additives, and specific examples thereof include the additives described in JP-A 2001-181549.

Further, a pair of compounds that generate an aggregate or increase viscosity when they react with each other upon mixing can be contained separately in the ink and the undercoating liquid in the invention. The above pair of compounds has a characteristic of rapidly forming the aggregate or rapidly increasing viscosity of the liquid, thereby suppressing coalescence of adjacent liquid droplets more effectively.

Examples of the reaction of the above pair of compounds include an acid/base reaction, a hydrogen bonding reaction by a carbonic acid/amide group containing compound, a crosslinking reaction such as a reaction of boronic acid/diol, and a reaction by electrostatic interaction by cation/anion.

The inkjet recording apparatus according to the invention will be further described below.

The inkjet recording apparatus according to the invention comprises: an undercoating liquid applying device for applying an undercoating liquid onto a recording medium, the undercoating liquid containing at least one surfactant in an amount of 0.001% or higher and the critical micelle concentration or lower, the surfactant exhibiting a surface tension of 25 mN/m or lower when the surfactant is dissolved in 1,6-hexanediol diacrylate at a critical micelle concentration; an undercoating liquid curing device for semi-curing the undercoating liquid by applying energy to at least a portion of the undercoating liquid, the undercoating liquid curing device being disposed at the downstream side of the undercoating liquid applying device in the traveling direction of the recording medium; and an image recording device for recording an image by ejecting an ink on the semi-cured undercoating liquid, the inks being curable by irradiation with an actinic ray, and the image recording device being disposed at the downstream side of the undercoating liquid curing device in the traveling direction of the recording medium.

Further, the inkjet recording apparatus according to the invention may further comprises: a conveying device for conveying the recording medium; and an actinic ray irradiator for irradiating the recording medium having an image recorded thereon by the image recording device with an actinic energy ray to further accelerate curing of the undercoating liquid and the ejected ink (or image), the actinic ray irradiator being disposed at the downstream side of the image recording device in the conveying path of the recording medium.

Further, the image recording device preferably ejects an ink using at least one line type inkjet head which is disposed in parallel with the direction orthogonal to the conveying direction of the recording medium, and has a length corresponding to the entire width of the recordable area of the recording medium.

The ink and the undercoating liquid used in the inkjet recording apparatus of the invention are the same as the ink and the undercoating liquid described in the inkjet recording method of the invention, and preferable examples are the same as therebetween.

-Image Recording Principle and Recording Apparatus-

The principle of the invention for recording an image (according to the invention, particularly an image area having a low dot density formed with a small amount of liquid) on a recording medium with high reproducibility while inter-droplet interference is prevented will be described hereinafter with reference to FIG. 5.

As shown in FIG. 5(*a*), an undercoating liquid containing no coloring agent is applied onto a recording medium 16 to form a liquid layer 81 composed of the undercoating liquid on the surface of the recording medium 16. The figure illustrates an embodiment in which the undercoating liquid is applied by coating. Alternatively, the undercoating liquid may be applied by ejecting (or "ejection") by means of an inkjet head or spray coating.

The thickness of the liquid film of the applied undercoating liquid is expressed in terms of an average thickness obtained by dividing the value of the volume of the applied undercoating liquid by the value of the area onto which the undercoating liquid is applied. In the case where the undercoating liquid is applied by ejection, the thickness of the liquid film can be obtained from the value of the ejected volume and the value of the area onto which the undercoating liquid has been ejected. The thickness of the liquid film of the undercoating liquid is preferably uniform with no local unevenness. From this viewpoint, the undercoating liquid is preferably wettable and spreadable on the recording medium, i.e., has a low static surface tension, as long as the liquid can be ejected stably from the inkjet head.

Next, as shown in FIG. 5(*b*), the ink droplets 82*a* are ejected after the undercoating liquid has been semi-cured by irradiation with actinic light from the light source W (semi-cured undercoating liquid (layer); 81*a*). By the ejecting, as shown in FIG. 5(*c*), the ink droplets 82*a* are impacted on the undercoating liquid 81*a*. At this time, the surface of the undercoat layer has a lower degree of curing than the inner portion of the layer, and readily conforms to the ink droplets 82*a*.

Further, as shown in FIG. 5(*d*), the succeeding ink droplets 82*b* are impinged on the recording medium 16 in the vicinity of the positions where the previously ejected first droplets 82*a* are impinged and the undercoating liquid 81*a* is present. At this time, the surface of the undercoat layer has a lower degree of curing than that of the inner portion of the layer, and readily conforms to the ink droplets 82*b*. Although a force for coalescence is exerted on the ink droplets 82*a* and the ink droplets 82*b*, an inter-droplet interference between impinged droplets is suppressed due to a high adhesiveness between the ink droplet and the undercoating layer surface, and the resistance of the semi-cured undercoating layer against the coalescence between the ink droplets.

A substance that causes a chemical reaction that allows a coloring material contained in the ink to be aggregated or insoluble has conventionally been contained in the undercoating liquid, in order to avoid the inter-droplet interference. However, according to the invention, the inter-droplet interference can be avoided without containing such a substance in the undercoating liquid.

Figure 5A:
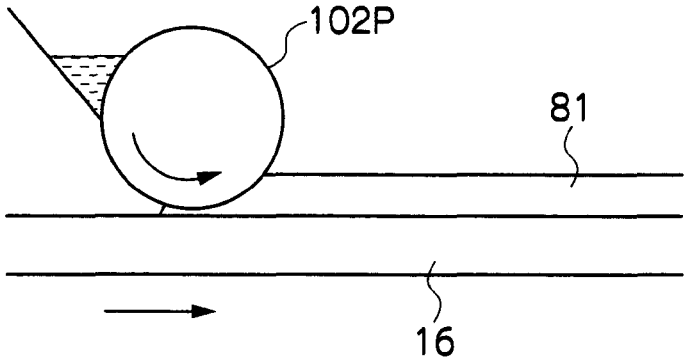
FIG. 5A to FIG. 5D are process chart for illustrating the principle of image formation.
Figure 5B:
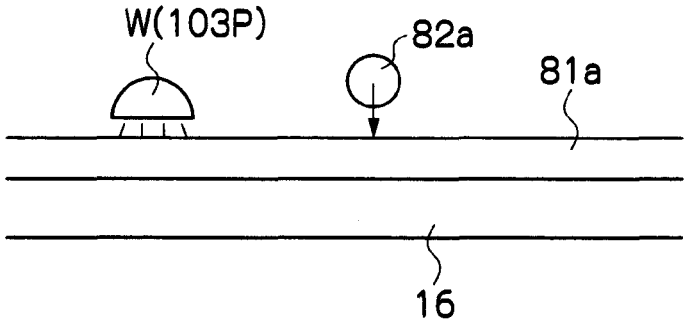
Figure 5C:
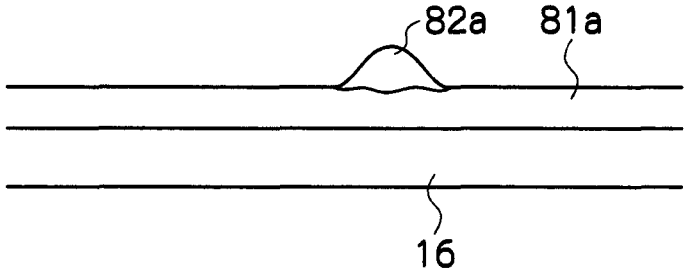
Figure 5D:
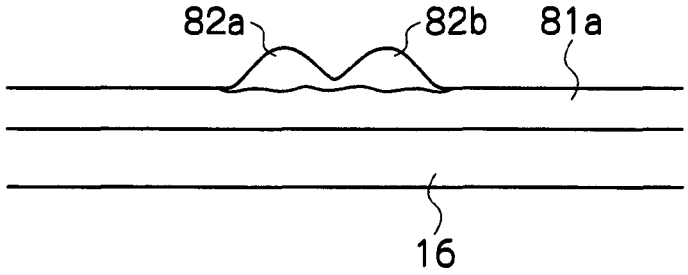

While the inter-droplet interference is avoided and the shapes of the ink droplets of 82*a* and 82*b* are maintained (in the case of the invention, during a period of from a few hundred milliseconds to 5 seconds) as shown in FIG. 5D, i.e., before the shapes of the droplets are deformed, the ink droplets 82*a* and 82*b* are cured or half-cured to a level such that the shapes thereof are kept, and the coloring material in the ink droplets 82*a* and 82*b* are fixed onto the recording medium 16. At least the ink contains an actinic ray curing-type polymerizable compound and is cured by a so-called polymerization reaction when irradiated with an actinic ray such as an ultraviolet ray. The polymerization compound can also be contained in the undercoating liquid, which is preferable for promoting adhesion since the whole liquid that has been ejected is cured.

Next, the overall structure of an inline label printer, an example of the image recording device provided with the inkjet recording device in the invention, will be explained with reference to the figures.

Figure 6:
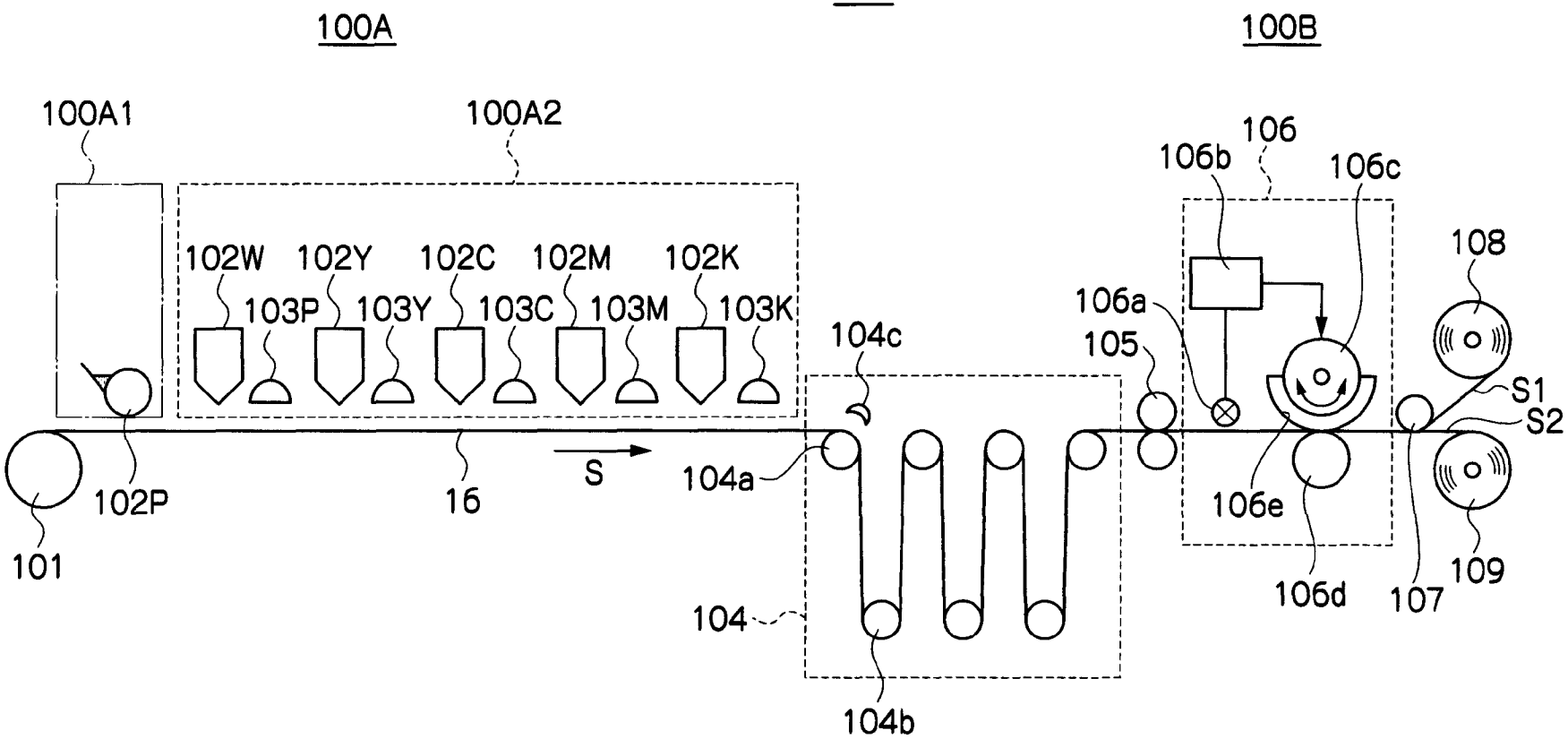
FIG. 6 is a schematic cross sectional view showing the entire structure of the image recording apparatus for recording an image according to the inkjet recording method of the invention.

FIG. 6 is an overall structural drawing showing one example of an inline label printer (image recording device) 100. The image recording device 100 consists of an inkjet recording part 100A in the invention, a post-processing part 100B that performs a post-processing to the recording medium that has been recorded an image, and a buffer 104 as a buffer unit provided between the inkjet recording part 100A and the post-processing part 100B.

The inkjet recording device in the invention is used for the inkjet recording part 100A. The inkjet recording part 100A consists of an undercoating liquid film forming unit 100A1 that forms an semi-cured undercoating liquid film that does not contain a coloring agent on the recording medium (label) 16, and an image forming unit 100A2 that forms a desired image on the recording medium 16 by applying four inks containing coloring materials onto a predetermined position of the recording medium 16.

The preferable images can particularly be formed when a recording medium that is not liquid permeable (for example, OPP (Oriented Polypropylene Film), CPP (Casted Polypropylene Film), PE (Polyethylene), PET (Polyethylene Terephthalate), PP (Polypropylene), a soft wrapping material with low permeability, laminate paper, coated paper and art paper) is used as the recording medium.

In FIG. 6, the inkjet recording part 100A is provided with the image forming unit 100A2 where an ink is applied by ink-ejecting onto the recording medium 16 on which the undercoating liquid has been applied with a roll coater 102P.

The image recording device 100 is provided with a liquid storage/loading unit (not shown) that is light-shielded and store the undercoating liquid and the ink to be supplied to the undercoating liquid film forming part 100A1 and the image forming part 100A2; a paper feed unit 101 for feeding the recording medium 16; an image detecting unit 104*c* that reads the result of impingement of the ink (the state of the impinged ink droplets) formed by the image forming part 100A2; and a take-up unit 109 for taking up the recorded recording medium.

In FIG. 6, as an example of the paper feeding unit 101, a unit for feeding roll paper (continuous paper) is shown. Alternatively, a unit for feeding cut paper may be used.

Further details of the inkjet recording unit 100A will be explained. The inkjet recording unit 100A has the image forming part 100A2 including ejecting heads 102Y, 102C, 102M, and 102K that eject ink onto the recording medium 16 in a single pass, pinning light sources 103Y, 103C, and 103M, and a final curing light source 103K; and the undercoating liquid film forming part 100A1 including the roll coater 102P and a light source for the undercoating liquid 103P. Specifically, it is a so-called full line type head which is a line type head having a length corresponding to the entire width of the recordable area of the recording medium 16, the head being arranged in a direction perpendicular to a direction of conveying the recording medium (shown by an arrow S in FIG. 2). Further, the pinning light sources 103Y, 103C, and 103M are respectively arranged at the downstream side of the ejecting heads 102Y, 102C and 102M, which cure the dots of ejected ink of each color at least to such a level that the dots do not lose their shape.

The roll coater 102P and the ejecting heads 102Y, 102C, 102M, and 102K having plural nozzles (liquid ejecting ports) are arranged in the length longer than at least one side of the recording medium 16 of the maximum size to be recorded by the use of the inkjet recording part 100A.

The ejecting heads 102Y, 102C, 102M, and 102K corresponding to each liquid are arranged in the order of yellow ink (Y), cyan ink (C), magenta ink (M), and black ink (K) from the upstream side (the left side of FIG. 6) along with the direction S of conveying the recording medium to be able to form a color image on the recording medium 16.

More specifically, in the first place, the undercoating liquid is evenly applied to the recording medium 16 by the roll coater (102P), and the undercoating liquid is semi-cured by the semi-curing UV light source 103P. Thereafter, an ink is ejected by the yellow inkjet head 102Y to the recording medium 16, and yellow ink on the recording medium is semi-cured by the pinning light source 103Y, which is disposed downstream of the head 102Y, with keeping the surface uncured and at least maintaining the shape of the droplets. Subsequently, the same step as the yellow ink is repeated using the heads 102C and 102M, and final ejecting is conducted using the black inkjet head 102K, then curing is completed using the final light source 103K having an ability to completely cure the undercoating liquid and all inks. Inter-droplet interference is avoided by semi-curing the undercoating liquid and ink after the application thereof.

According to the image forming part 100A2 consisting of a full line type ejecting head, an image can be recorded over the entire width of the entire surface of the recording medium 16 at one operation of moving the recording medium 16 relative to the image forming part 100A2 in a direction of conveying the recording medium. Therefore, a high-speed printing can be performed as compared with a case of using a shuttle type head in which the ejecting head moves reciprocatingly in a direction perpendicular to the direction of conveying the recording medium while conveying the recording medium, thereby improving the productivity.

The present aspect is composed of four standard colors, or Y, C, M, and K. The number or combination of colors is not limited to the example illustrated by the present embodiment, and, if necessary, a pale color ink, a deep color ink, a special color ink such as a white or other color ink, a transparent ink, and the like may be added. Examples of possible systems include a structure further including an inkjet head for ejecting a light-colored ink such as a light cyan or light magenta ink, a system drawing the background with a white ink, and a system adjusting the glossiness by a transparent ink.

The UV light sources 103P, 103Y, 103C, 103M, and 103K emit UV light toward the recording medium 16 to cure the inks containing a polymerizable compound. Examples of the UV light source include known light sources such as a medium pressure mercury lamp, a high-pressure mercury lamp, an ultrahigh pressure mercury lamp, a metal halide lamp, a xenon lamp, a carbon arc lamp, an ultraviolet fluorescent lamp, an ultraviolet LED, and an ultraviolet LD. Among them, a high-pressure mercury lamp, an ultrahigh pressure mercury lamp, or a metal halide lamp is preferable from the viewpoint of practicality. The UV light source preferably has a peak light intensity in the wavelength range of 200 nm to 400 nm, and an irradiation light intensity of 1 to 500 $mW/cm^2$ at the light intensity peak wavelength. The UV light source is preferably composed of a cold mirror as the reflector, and an infrared ray cut-off glass as a cover glass, for preventing a rise of temperature of the recording medium due to heat ray irradiation. Although not shown in FIG. 6, in the case where an ink containing a radical-based polymerizable compound is used, the curing atmosphere produced by the final curing light source 103K may be replaced with an inert gas (for example, nitrogen) for suppressing polymerization inhibition by oxygen to achieve more favorable curing and fixing of the ink.

An electron beam irradiation device (not shown) may also be used as a means of curing the ink containing a polymerizable compound.

In the above, the use of a UV light source and an electron beam irradiation device is discussed as a means of curing the polymerizable compound, but the means is not limited to thereto and other radiation rays such as an $\alpha$-ray, a $\gamma$-ray, and an X-ray may also be used.

The image detecting unit 104*c* includes an image sensor (such as a line sensor) to pick up the image resulting from the ejection by the image forming part 100A2, and functions as a means of checking the presence of ejection abnormalities such as clogging of the nozzles from the image read by the image sensor.

A buffer 104 is provided as a cushioning unit between the inkjet recording part 100A and the post-processing part 100B. The recording medium that has been subjected to inkjet recording passes through the buffer 104 consisting of several upper rollers 104*a* and several lower rollers 104*b*, while serpentine up and down several times. The buffer 104 serves as a regulator that absorbs the difference between the operation speed (the speed for conveying the recording medium 16) in the inkjet recording part 100A positioned at the upstream side of the buffer and the operation speed (the speed for conveying the recording medium 16) in a post-processing part 100B, which will be described later, positioned in the downstream of the buffer.

In the downstream of the buffer 104 is provided a varnish coater 105. In the vanish coater 105, the surface of a label is slightly coated with a varnish to improve scratch-resistance of the label surface.

A label cutting unit 106 provided in the downstream of the vanish coater 105 is composed of a marking reader 106*a*, a die cutter driver 106*b*, a die cutter 106*c* equipped with a roll (a plate) 106*e* having a blade, and an opposed roller 106*d*.

A label cut by the die cutter 106*c* in the label cutting unit 106 is wound up by a label winding unit 109 into the form of a product, and other parts are peeled off by a scrap removing unit 108 and disposed as a waste.

*Structure of Ejecting Head

Figure 7A:
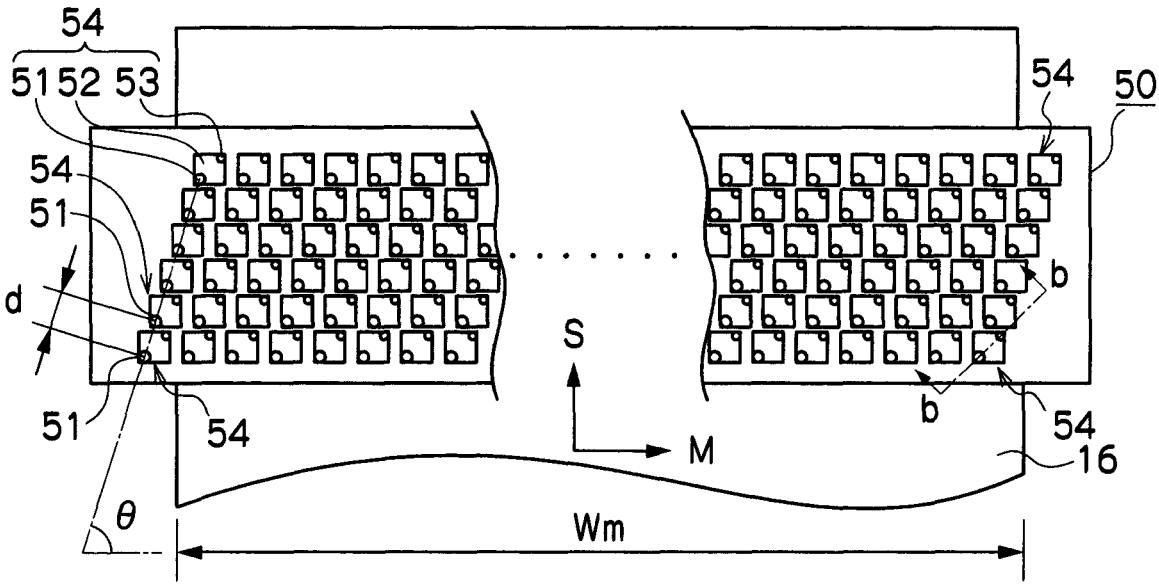
FIG. 7A is a plan view showing an example of the basic entire structure of the inkjet head shown in FIG. 6.

FIG. 7A is a plan perspective view showing an example of the entire basic structure of an ejecting head 50 marked with reference numerals, the head 50 being representative of the ejecting heads 102Y, 102C, 102M, and 102K.

The ejecting head 50 shown as one example in FIG. 7A is a so-called full line type head equipped with a number of nozzles 51 (liquid ejection port) that eject liquid toward the recording medium 16 arranged in a two-dimensional manner over the length corresponding to the width Wm of the recording medium 16 in a direction (the main scanning direction indicated by an arrow M) which is perpendicular to the direction of conveying the recording medium 16 (the sub-scanning direction indicated by an arrow S).

In the inkjet head 50, nozzles 51, pressure chambers 52 communicated with the nozzles 51, and a plurality of pressure chamber units 54 containing a liquid supply port 53 are disposed along two directions, or the main scanning direction M and the oblique direction having a specified acute angle θ ($0<\theta<90$) relative to the main scanning direction M. For the convenience of illustration, FIG. 7A shows only a portion of pressure chamber units 54.

The nozzles 51 are arranged at a regular pitch d in the inclined direction at a prescribed acute angle θ with the main scanning direction M. The configuration can be equated to the configuration in which the nozzles are arranged in a straight line along the main scanning direction M at an interval of "$d\times\cos\theta$".

Figure 7B:
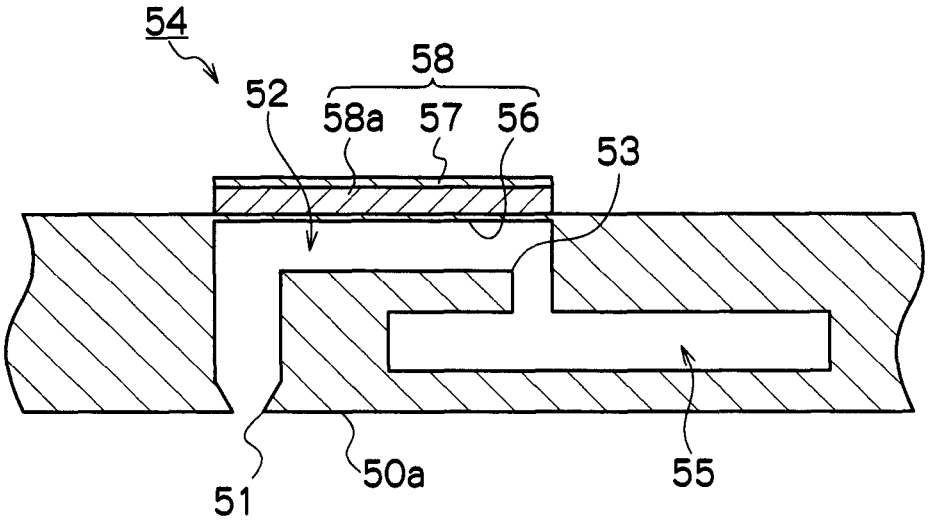
FIG. 7B is a cross-sectional view cut along the line b-b in FIG. 7A.

FIG. 7B shows a cross section along the b-b line shown in FIG. 7A of the pressure chamber unit 54 as an ejection element that constitutes the ejection head 50.

Each pressure chamber 52 communicates with a common liquid chamber 55 via the liquid supplying port 53 as shown in FIG. 7B. The common liquid chamber 55 communicates with a tank as a liquid supplying source (not shown), from which the liquid is supplied and distributed to each pressure chamber 52 via the common liquid chamber 55.

A piezoelectric body 58*a* is positioned on a vibrating plate 56 that forms a top face of the pressure chamber 52, and an individual electrode 57 is positioned on the piezoelectric body 58*a*. The vibrating plate 56 is grounded and functions as a common electrode. These vibrating plate 56, individual electrode 57 and piezoelectric body 58*a* constitute a piezoelectric actuator 58 that serves as a means of generating liquid ejection force.

When a prescribed driving voltage is applied to the individual electrode 57 in the piezoelectric actuator 58, the piezoelectric body 58*a* is deformed to change the volume of the pressure chamber 52, resulting in the change in pressure in the pressure chamber 52, and thereby a liquid is ejected from the nozzle 51. When the volume of the pressure chamber 52 returns back to the initial state after the ejection of the liquid, a new liquid is supplied to the pressure chamber 52 from the common liquid chamber 55 via the liquid supplying port 53.

In FIG. 7A, an example is shown in which a number of the nozzles 51 are arranged in a two-dimensional manner as the structure capable of forming an image with a high resolution on the recording medium 16 at high-speed. However, the structure of the ejecting head in the invention is not particularly limited to the above structure and may be a structure in which the nozzles are arranged in a one-dimensional manner. The structure of the pressure chamber unit 54 as an ejection element that constitutes the ejecting head is also not particularly limited to the example shown in FIG. 7B. For example, the common liquid chamber 55 may be positioned above the pressure chamber 52 (i.e., the opposite side of the ejection face 50*a*) instead of positioning the same under the pressure chamber 52 (i.e., the ejection face 50*a* side of the pressure chamber 52). Further, the liquid ejection force may be generated by an exothermic body in place of the piezoelectric body 58*a*.

In the inkjet recording device in the invention, other means such as ejection of the undercoating liquid from the nozzle may also be used for the application of the undercoating liquid onto the recording medium, instead of coating.

The device used for the coating is not particularly limited, and known coating devices can appropriately be selected according to objectives. Examples thereof include an air doctor coater, a blade coater, a rod coater, a knife coater, a squeeze coater, a dip coater, a reverse roll coater, a transfer roll coater, a gravure coater, a kiss roll coater, a cast coater, a spray coater, a curtain coater, and an extruding coater.

*Liquid Supply System

Figure 8:
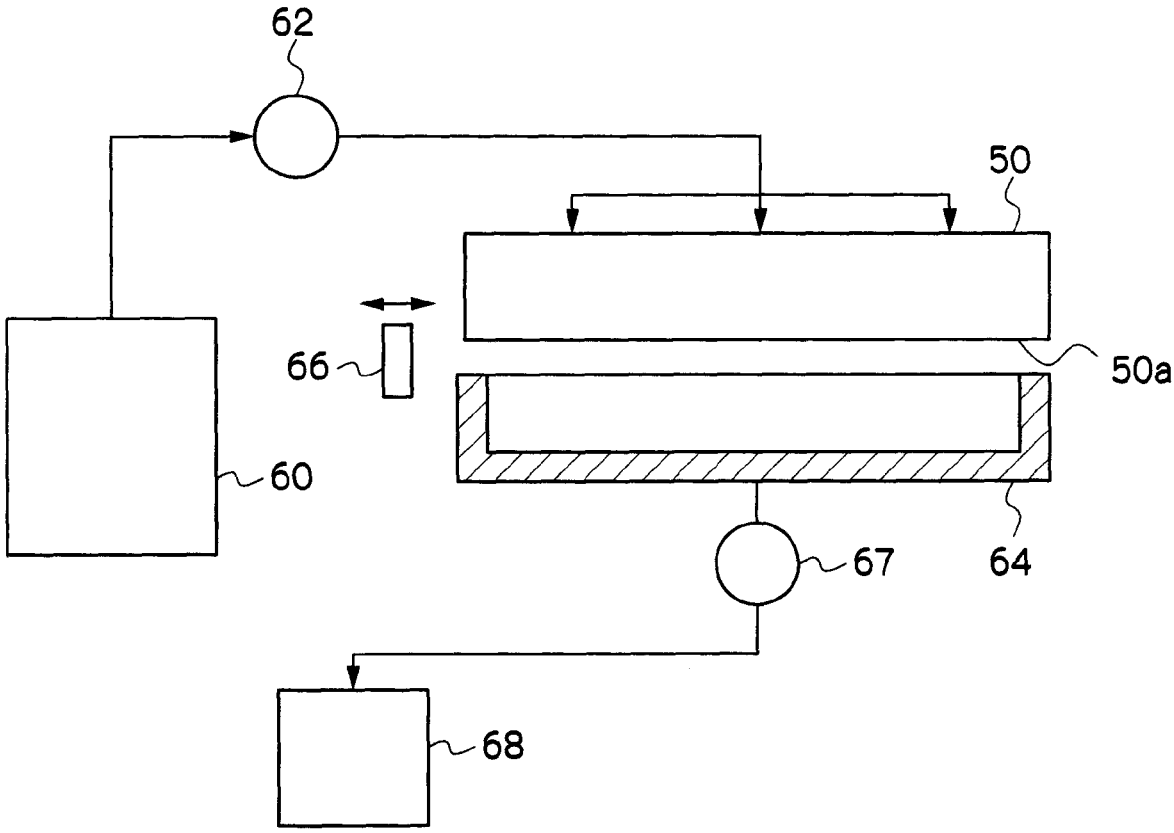
FIG. 8 is a schematic view showing an example of the structure of a liquid supplying system constituting the image recording apparatus.

FIG. 8 is a schematic view showing a configuration of the liquid supply system in the image recording device 100.

A liquid tank 60 supplies a liquid to the ejecting head 50 as a base tank. In the midstream of a tube that connects the liquid tank 60 with the ejecting head 50, a liquid supplying pump 62 that supplies the liquid to the ejecting head 50 is provided. The temperature of the liquid tank 60 and the ejecting head 50 and the tube for connecting thereof, and the temperature of the ink contained therein are preferably controlled by a temperature detecting means and a heater. The ink temperature is preferably regulated to a range of from 40° C. to 80° C.

The image recording device 100 is provided with a cap 64 as a means for preventing a meniscus of the nozzle 51 from drying during downtime of ejection over a long period of time, or from increasing in viscosity in the vicinity of the meniscus, and a cleaning blade 66 as a means for cleaning the ejection face 50*a*. A maintenance unit including the cap 64 and the cleaning blade 66 can be moved relative to the ejecting head 50 by a moving mechanism (not shown), and can be moved to a maintenance position positioned below the ejecting head 50 from a prescribed retracted position, if necessary.

The cap 64 is elevated relative to the ejecting head 50 with an elevation mechanism (not shown). The elevation mechanism is designed to cover at least the region of the nozzle in the ejection face 50*a* with the cap 64 by elevating the cap 64 to a prescribed position and bringing the cap 64 into close contact with the ejecting head 50.

The interior of the cap 64 is preferably divided into plural spaces, each of which corresponds to each row of the nozzles by partition walls, and each of the divided spaces can be selectively suctioned using a selector or the like.

The cleaning blade is made of an elastic member such as rubber, and is slidable on the ejection face 50*a* of the ejecting head 50 by a moving mechanism for the cleaning blade (not shown). When the liquid droplets or foreign matters are attached onto the ejection face 50*a*, the ejection face 50*a* is wiped and cleaned by sliding the cleaning blade 66 on the ejection face 50*a*.

A suction pump 67 sucks a liquid from the nozzle 51 of the ejecting head 50 in a state that the ejection face 50*a* of the ejecting head 50 is covered with the cap 64, and sends the sucked liquid to a collection tank 68.

The above suction operation is also performed when the liquid tank 60 is loaded in the image recording device 100 and the liquid tank 60 is filled with a liquid from the liquid tank 60 (at the time of the initial filling) or when the liquid having an increased viscosity after downtime of the device over a long period of time is removed (at the time of starting up after a long-term downtime).

Note that there are two types of ejections from the nozzle: first, a normal ejection performed onto a recording medium such as paper in order to form an image; and second, a purge performed onto the cap 64 serving as a liquid receiver (also referred to as a blank ejection).

Further, when air bubbles are mixed into the nozzle 51 or the pressure chamber 52 in the ejecting head 50 or an increase in the viscosity in the nozzle 51 exceeds a certain level, the liquid cannot be ejected from the nozzle 51 by the above-described blank ejection. In this case, the liquid with the air bubbles or increased viscosity in the pressure chamber 52 in the ejecting head 50 is sucked by the suction pump 67 by applying the cap 64 onto the ejection face 50*a* in the ejecting head 50.

The ejecting head 50, liquid tank 60, liquid supplying pump 62, cap 64, cleaning blade 66, suction pump 67, collection tank 68 and an ink flowing route connecting these units, as well as other members and equipment with which the ink directly contact, preferably have dissolution resistance and swelling resistance. Further, these members and equipment preferably have a light shielding property.

*Control System

Figure 9:
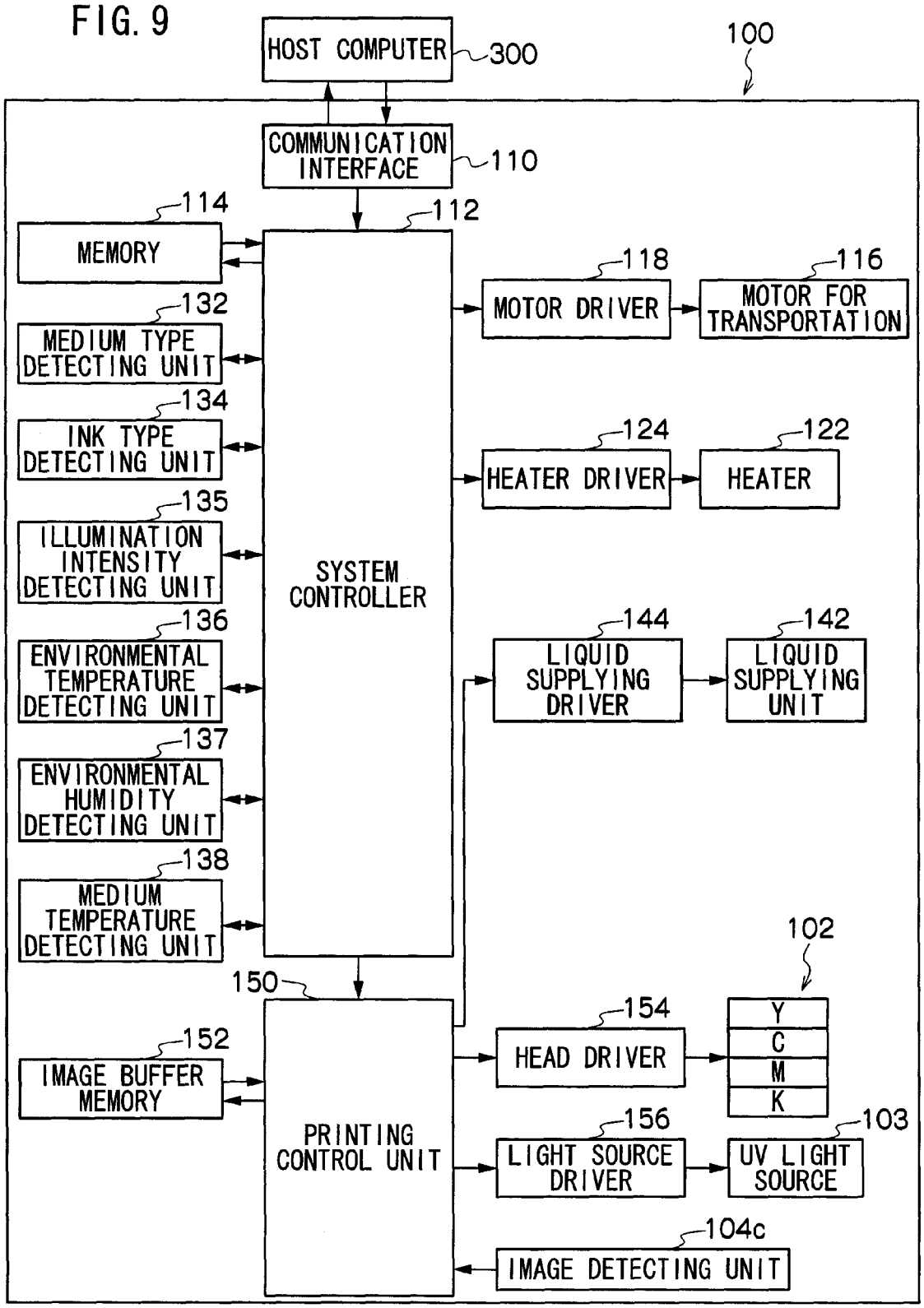
FIG. 9 is a block diagram showing an example of the structure of a control system constituting the image recording apparatus.

FIG. 9 is a block diagram of the main part showing a system configuration of the image recording device 100.

In FIG. 9, the image recording device 100 is mainly composed of an image forming unit 102, image detecting unit 104*c*, UV light source 103, communication interface 110, system controller 112, memory 114, image buffer memory 152, motor for transportation 116, motor driver 118, heater 122, heater driver 124, medium type detecting unit 132, ink type detecting unit 134, illumination intensity detecting unit 135, ambient temperature detecting unit 136, ambient humidity detecting unit 137, medium temperature detecting unit 138, liquid supplying unit 142, liquid supplying driver 144, printing control unit 150, head driver 154, and a light source driver 156.

Since the image forming unit 102 is shown as a representative of the ejecting heads 102Y, 102C, 102M and 102K shown in FIG. 6, the UV light source is shown as a representative of the curing light sources 103P, 103Y, 103C, 103M and 103F shown in FIG. 6, and the image detecting unit 104*c* is the same as the one described in FIG. 6 which have been mentioned above, further explanation thereof is omitted here.

The communication interface 110 is an image data inputting means that receives the image data sent from a host computer 300. For the communication interface 110, wired interfaces such as USB (Universal Serial Bus) or IEEE1394, or wireless interfaces can be applied. The image data inputted into the image recording device 100 via the communication interface 110 are temporarily stored in a first memory 114 for memorizing image data.

The system controller 112 is composed of a central processing unit (CPU), its peripheral circuits, and the like, and is a main controlling means of controlling the entire image recording device 100 according to a prescribed program that has been previously stored in the first memory 114. That is, the system controller 112 controls each unit of the communication interface 110, motor driver 118, heater driver 124, medium type detecting unit 132, ink type detecting unit 134, and the printing control unit 150.

The motor for transportation 116 imparts a driving force to rollers, belts or the like for transporting a recording medium. By this motor for transportation 116, the ejecting head 50 that constitutes the image forming unit 102 and the recording medium move relatively to each other. The motor driver 118 is a circuit that drives the motor for transportation 116 in accordance with commands from the system controller 112.

The heater 122 is a circuit that drives a heater (or a cooling element) 122 which is not shown in the Figure, and keeps the temperature of the recording medium constant. The heater driver 124 is a circuit that drives the heater 122 in accordance with commands given from the system controller 112.

The medium type detecting unit 132 detects the type of the recording medium. There are various embodiments of detecting the type of the recording medium and examples thereof include an embodiment of detecting the type by a sensor provided at a paper feeding unit which is not shown in the Figure; an embodiment of inputting the type by the operation of a user; an embodiment of inputting the type from the host computer 300; and an embodiment in which the type is automatically detected by analyzing the image data (for example, resolution or color) inputted from the host computer 300 or supplemental data of the image data.

The ink type detecting section 134 detects the ink type. There are various embodiments of detecting the ink type. For example, an embodiments of detecting the ink type with a sensor provided on a liquid storage/charge section (not shown), an embodiments of inputting the ink type by user's operation, an embodiments of inputting the ink type from the host computer 300, and an embodiment of automatically detecting the ink type by analyzing the image data (for example, resolution or color) or the additional data to the image data inputted from the host computer 300.

The illumination intensity detecting unit 135 detects the illumination intensity of the UV ray emitted from the UV light source 103. Examples of the embodiments of detecting the illumination intensity include an embodiment of detecting the illumination intensity by a sensor provided near the UV light source 103 shown in FIG. 6. The output of this illumination intensity sensor is fed back to the UV light source to control the output thereof.

The ambient temperature detecting unit 137 detects the temperatures of the outside air and the inside of the image recording device. Examples of the embodiments of detecting the ambient temperature include an embodiment of detecting the ambient temperature by a sensor provided at the outside or inside of the device.

The ambient humidity detecting unit 136 detects the humidity of the outside air and the inside of the image recording device. Examples of the embodiments of detecting the ambient humidity include an embodiment of detecting the humidity by a sensor provided at the outside or the inside of the device.

The medium temperature detecting unit 138 detects the temperature of the recording medium at the time of forming an image. There are various embodiments of detecting the medium temperature and examples thereof include an embodiment of detecting the temperature by a contact type temperature sensor and an embodiment of detecting the temperature by a non-contact type temperature sensor provided above the recording medium 16. The temperature of the recording medium is maintained constant by the heater 122.

The liquid supplying unit 142 is composed of a tube through which the ink flows from the liquid tank 60 shown in FIG. 8 to the image forming unit 102, the liquid supplying pump 62, and the like.

The liquid supplying driver 144 is a circuit that drives the liquid supplying pump that constitutes the liquid supplying unit and the like so that the liquid can be supplied to the image forming unit 102.

The printing control unit 150 produces the data (ejection data) necessary for each ejecting head 50 that constitute the image forming unit 102 to perform liquid ejection (ejecting) toward the recording medium based on the image data inputted in the image recording device 100. That is, the printing control unit 150 functions as an image processing means that performs image processing such as various processes, corrections or the like to generate the ejection data from the image data stored in the first memory 114 in accordance with the control of the system controller 112, and supplies the generated ejection data to the head driver 154.

A second memory 152 is adjunct to the printing control unit 150 and the ejection data and the like are temporarily stored in the second memory 152 at the time of performing the image processing in the printing control unit 150.

The second memory 152 is shown as an embodiment in which the memory is adjunct to the printing control unit 150 in FIG. 9. However, the first memory 114 can also function as the second memory 152 at the same time. Further, the printing control unit 150 and the system controller 112 can also be integrated and configured with a single processor.

The head driver 154 outputs driving signals for ejection to each of the ejecting heads 50 composing the image forming section 12, on the basis of the ejecting data given by the print control unit 150 (practically ejection data stored in the second memory 152). The driving signals for ejection outputted from the head driver 154 are given to each of the ejecting heads 50 (specifically the actuator 58 shown in FIG. 7B), thereby the liquid (droplets) is ejected from the ejecting head 50 to the recording medium.

A light source driver 156 is a circuit that controls the voltage, time and the timing to be inputted in the UV light source 103 based on the commands given from the printing control unit 150, the illumination intensity detected by the illumination intensity detecting unit 135, the ambient temperature detected by the ambient temperature detecting unit 136, the ambient humidity detected by the ambient humidity detecting unit 137 and the medium temperature detected by the medium temperature detecting unit 138, and drives the UV light source 103.

The invention has been completed on the basis of the finding that dots formed by ink ejection spread within a certain range, and the dot shape is maintained when the spread dots are connected to each other.

If the dots spread within a desired range, and the dot shape is maintained when the dots are connected to each other, a desired density can be obtained even with a low-cost apparatus having a low-resolution head unit, which leads to improvement of the quality of the recorded image.

Exemplary aspects of the invention are listed below.

(1) A first aspect is an inkjet recording method comprising:

applying an undercoating liquid onto a recording medium, the undercoating liquid containing at least one surfactant in an amount of from 0.001% to a critical micelle concentration, the surfactant imparting a surface tension of 25 mN/m or less when the surfactant is dissolved in 1,6-hexanediol diacrylate at a critical micelle concentration;

semi-curing the undercoating liquid; and recording an image by ejecting an ink onto the semi-cured undercoating liquid, the ink being curable by irradiation with an actinic ray.

(2) A second aspect is the inkjet recording method of the first aspect, wherein the content of the surfactant is no more than ½ of the critical micelle concentration.

(3) A third aspect is the inkjet recording method of the first aspect, wherein the undercoating liquid is semi-cured by irradiation with an actinic ray.

(4) A fourth aspect is the inkjet recording method of first aspect, wherein the amount of actinic property is from 1 to 500 mJ/cm$^2$.

(5) A fifth aspect is the inkjet recording method of the first aspect, wherein the undercoating liquid is semi-cured by heating.

(6) A sixth aspect is the inkjet recording method of the fifth aspect, wherein the semi-curing of the undercoating liquid by heating is performed by heating for 0.1 to 1 seconds under conditions such that the surface temperature of the recording medium is in the range of from 40 to 80° C.

(7) The inkjet recording method of claim 1, wherein the undercoating liquid is semi-cured by irradiation with UV light.

(8) An eighth aspect is the inkjet recording method of the first aspect, wherein the undercoating liquid further contains a radical polymerizable composition.

(9) A ninth aspect is the inkjet recording method of first aspect, wherein the amount of the undercoating liquid applied is in the range of from 0.05 to 5 when the amount of ink droplets is 1.

(10) A tenth aspect is the inkjet recording method of first aspect, wherein an interval between the applying of the undercoating liquid to ejecting ink droplets is from 5 seconds to 10 seconds.

(11) An eleventh aspect is the inkjet recording method of first aspect, wherein the image recording comprises recording using an ink set containing multiple color inks, and semi-curing at least one of the color inks that are ejected.

(12) A twelfth aspect is the inkjet recording method of eleventh aspect, wherein the semi-curing comprises semi-curing each of the ejected color inks.

(13) A thirteenth aspect is the inkjet recording method of first aspect, further comprising further enhancement of curing of the undercoating liquid and the ejected ink.

(14) A fourteenth aspect is the inkjet recording method of thirteenth aspect, wherein the further enhancement of curing of the undercoating liquid and the ejected ink comprises applying energy.

(15) A fifteenth aspect is the inkjet recording method of first aspect, wherein the curing sensitivity of the ink is equivalent to or higher than the curing sensitivity of the undercoating liquid.

(16) A sixteenth aspect is an inkjet recording apparatus comprising: an undercoating liquid application device for applying an undercoating liquid on a recording medium, the undercoating liquid containing at least one surfactant in an amount of from 0.001% to a critical micelle concentration, the surfactant achieving a surface tension of 25 mN/m or lower when dissolved in 1,6-hexanediol diacrylate at a critical micelle concentration; an undercoating liquid curing device for semi-curing the undercoating liquid by applying energy to at least a portion of the undercoating liquid, the undercoating liquid curing device being disposed downstream of the undercoating liquid application device in a traveling direction of the recording medium; and an image recording device for recording an image by ejecting an ink onto the semi-cured undercoating liquid, the ink being curable by irradiation with an actinic ray, and the image recording device being disposed downstream of the undercoating liquid curing device in the traveling direction of the recording medium.

(17) A seventeenth aspect is the inkjet recording apparatus of sixteenth aspect, further comprising a device for transporting the recording medium, and a device for radiating an actinic ray, the device for radiating an actinic ray being disposed downstream of the image recording device in a conveyance direction of the recording medium to be conveyed, and radiating an actinic ray to the recording medium having an image recorded thereon by the image recording device to further accelerate curing of the undercoating liquid and the ejected ink, wherein the image recording device ejects the ink using at least one line type inkjet head which is disposed in parallel with a direction orthogonal to the conveyance direction of the recording medium, and has a length corresponding to the entire width of a recordable portion of the recording medium.

EXAMPLES

The invention is further illustrated by the following examples, however the invention is not limited to the following examples without departing from the scope of the invention. Unless otherwise specified, "parts" are based on the mass.

Example 1

<Preparation of Cyan Pigment Dispersion P-1>

16 g of PB 15:3 (trade name: IRGALITE BLUE GLO, manufactured by CIBA SPECIALTY CHEMICALS), 48 g of dipropylene glycol diacrylate (trade name: DPGDA, manufactured by DAICEL-CYTEC COMPANY LTD.), and 16 g of SOLSPERSE 32000 (manufactured by ZENECA) were mixed, and stirred for 1 hour with a stirrer. The mixture after stirring was dispersed with an Eiger mill, thus a pigment dispersion P-1 was obtained.

The dispersion was conducted for 1 hour at a rotation speed of 9 m/s together with zirconia beads having a diameter of 65 mm filled with a filling rate of 70%.

<Preparation of Cyan Inkjet Recording Liquid I-1>

Components of the following composition were mixed by stirring to make a solution, thus an inkjet recording liquid I-1 for cyan image recording was prepared. The inkjet recording liquid I-1 had a surface tension (25° C.) of 27 mN/m, and a viscosity (25° C.) of 15 mPa·s.

<Composition>

| | |
|---|---|
| Above-described pigment dispersion P-1 | 2.16 g |
| Dipropylene glycol diacrylate (polymerizable compound) (Trade name: DPGDA, manufactured by DAICEL-CYTEC COMPANY LTD.) | 9.84 g |
| Below-described polymerization initiator Irg 907 (Manufactured by CIBA SPECIALTY CHEMICALS) | 1.5 g |
| Below-described sensitizer DALOCURE ITX (manufactured by CIBA SPECIALTY CHEMICALS) | 0.75 g |
| Below-described sensitizer DALOCURE EDB (manufactured by CIBA SPECIALTY CHEMICALS) | 0.75 g |

<Preparation of Magenta Pigment Dispersion P-2>

A magenta pigment dispersion P-2 was prepared in the same manner as the cyan pigment dispersion P-1, except that the pigment PB15:3 (trade name: IRGALITE BLUE GLO, manufactured by CIBA SPECIALTY CHEMICALS) used in the preparation of the cyan pigment dispersion P-1 was replaced with PV19 (trade name: CINQUASIA MAGENTA RT-355D, manufactured by CIBA SPECIALTY CHEMICALS), and the dispersant SOLSPERSE 32000 used therein was replaced with BYK168 (manufactured by BYK-CHEMIE).

<Preparation of Yellow Pigment Dispersion P-3>

An yellow pigment dispersion P-3 was prepared in the same manner as the cyan pigment dispersion P-1, except that the pigment PB15:3 (trade name: IRGALITE BLUE GLO, manufactured by CIBA SPECIALTY CHEMICALS) used in the preparation of the cyan pigment dispersion P-1 was replaced with PY120 (trade name: NOVOPERM YELLOWH2G, manufactured by Clariant), and the dispersant SOLSPERSE 32000 used therein was replaced with BYK168 (manufactured by BYK-CHEMIE).

<Preparation of Black Pigment Dispersion P-4>

A black pigment dispersion P-4 was prepared in the same manner as the cyan pigment dispersion P-1, except that the pigment PB15:3 (trade name: IRGALITE BLUE GLO, manufactured by CIBA SPECIALTY CHEMICALS) used in the preparation of the cyan pigment dispersion P-1 was replaced with carbon black (trade name: SPECIAL BLACK 250, manufactured by DEGUSSA), and the dispersant SOLSPERSE 32000 used therein was replaced with SOLSPERSE 5000 (manufactured by ZENECA).

<Preparation of Magenta Inkjet Recording Liquid I-2>

Components of the following composition were mixed by stirring to make a solution, thus an inkjet recording liquid I-2 for magenta image recording was prepared. The inkjet recording liquid I-2 had a surface tension (25° C.) of 27 mN/m, and a viscosity (25° C.) of 16 mPa·s.

<Composition>

| | |
|---|---|
| Above-described pigment dispersion P-2 | 5.86 g |
| Dipropylene glycol diacrylate (polymerizable compound) (Trade name: DPGDA, manufactured by DAICEL-CYTEC COMPANY LTD.) | 6.14 g |
| Below-described polymerization initiator Irg907 (Manufactured by CIBA SPECIALTY CHEMICALS) | 1.5 g |
| Below-described sensitizer DALOCURE ITX (manufactured by CIBA SPECIALTY CHEMICALS) | 0.75 g |
| Below-described sensitizer DALOCURE EDB (manufactured by CIBA SPECIALTY CHEMICALS) | 0.75 g |

<Preparation of Yellow Inkjet Recording Liquid I-3>

Components of the following composition were mixed by stirring to make a solution, thus an inkjet recording liquid I-3 for yellow image recording was prepared. The inkjet recording liquid I-3 had a surface tension (25° C.) of 27 mN/m, and a viscosity (25° C.) of 16 mPa·s.

<Composition>

| | |
|---|---|
| Above-described pigment dispersion P-3 | 4.68 g |
| Dipropylene glycol diacrylate (polymerizable compound) (Trade name: DPGDA, manufactured by DAICEL-CYTEC COMPANY LTD.) | 7.32 g |

-continued

| | |
|---|---|
| Below-described polymerization initiator Irg907 (Manufactured by CIBA SPECIALTY CHEMICALS) | 1.5 g |
| Below-described sensitizer DALOCURE ITX (manufactured by CIBA SPECIALTY CHEMICALS) | 0.75 g |
| Below-described sensitizer DALOCURE EDB (manufactured by CIBA SPECIALTY CHEMICALS) | 0.75 g |

<Preparation of Black Inkjet Recording Liquid I-4>

Components of the following composition were mixed by stirring to make a solution, thus an inkjet recording liquid I-4 for black image recording was prepared. The inkjet recording liquid I-4 had a surface tension (25° C.) of 27 mN/m, and a viscosity (25° C.) of 15 mPa·s.

<Composition>

| | |
|---|---|
| Above-described pigment dispersion P-4 | 3.3 g |
| Dipropylene glycol diacrylate (polymerizable compound) (Trade name: DPGDA, manufactured by DAICEL-CYTEC COMPANY LTD.) | 8.7 g |
| Below-described polymerization initiator Irg907 (Manufactured by CIBA SPECIALTY CHEMICALS) | 1.5 g |
| Below-described sensitizer DALOCURE ITX (manufactured by CIBA SPECIALTY CHEMICALS) | 0.75 g |
| Below-described sensitizer DALOCURE EDB (manufactured by CIBA SPECIALTY CHEMICALS) | 0.75 g |

<Preparation of Undercoating Liquid II-1>

Components of the following composition were mixed by stirring to make a solution, thus an undercoating liquid II-1 containing no specific surfactant was prepared. The undercoating liquid II-1 had a surface tension (25° C.) of 27 mN/m, and a viscosity (25° C.) of 12 mPa·s.

<Composition>

| | |
|---|---|
| Dipropylene glycol diacrylate (polymerizable compound) (Trade name: DPGDA, manufactured by DAICEL-CYTEC COMPANY LTD.) | 12.0 g |

-continued

| | |
|---|---|
| Below-described polymerization initiator Irg907 (Manufactured by CIBA SPECIALTY CHEMICALS) | 1.5 g |
| Below-described sensitizer DALOCURE ITX (manufactured by CIBA SPECIALTY CHEMICALS) | 0.75 g |
| Below-described sensitizer DALOCURE EDB (manufactured by CIBA SPECIALTY CHEMICALS) | 0.75 g |

Irg907

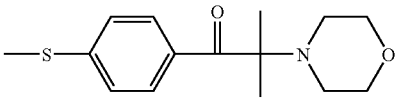

DALOCURE ITX

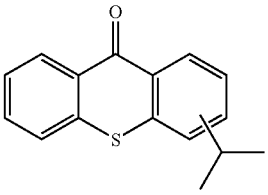

DALOCURE EDB

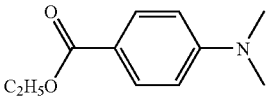

<Preparation of Undercoating Liquids II-2 to II-25>

Undercoating liquids II-2 to II-25 were prepared in the same manner as the undercoating liquid II-1, except that each of the surfactants listed in the following Table 1 was added in an addition amount indicated therein.

In the preparation of the undercoating liquids, DPGDA was reduced from the undercoating liquid II-1 in an amount corresponding to the added amount of the surfactant so as to bring the sum of the added surfactant and DPGDA into 15 g.

The following specific surfactant components (species) were used for the preparation of the undercoating liquids II-2 to II-25.

TABLE 1

| Undercoating liquid | Surfactant type | Surface tension of solution in 1,6-hexanediol diacrylate at a critical micelle concentration | Surfactant content Mass % with respect to total solution | Surface tension of undercoating liquid | Viscosity of undercoating liquid |
|---|---|---|---|---|---|
| II-1 | — | — | — | 27 mN/m | mPa · s |
| II-2 | BYK307 | 22 mN/m | 0.025% | 25 mN/m | 12 |
| II-3 | BYK307 | 22 mN/m | 0.05% | 24 mN/m | 12 |
| II-4 | BYK307 | 22 mN/m | 0.1% | 24 mN/m | 12 |
| II-5 | BYK307 | 22 mN/m | 0.2% | 23 mN/m | 12 |
| II-6 | BYK307 | 22 mN/m | 0.5% | 23 mN/m | 12 |
| II-7 | BYK307 | 22 mN/m | 1% | 22 mN/m | 12 |
| II-8 | BYK307 | 22 mN/m | 1.7% | 22 mN/m | 12 |
| II-9 | BYK307 | 22 mN/m | 10% | 21 mN/m | 17 |
| II-10 | KF354L | 35 mN/m | 0.025% | 28 mN/m | 12 |
| II-11 | KF354L | 35 mN/m | 10% | 29 mN/m | 17 |
| II-12 | KF351 | 30 mN/m | 0.025% | 26 mN/m | 12 |
| II-13 | KF351 | 30 mN/m | 10% | 25 mN/m | 17 |
| II-14 | KF414 | 24 mN/m | 0.025% | 27 mN/m | 12 |
| II-15 | KF414 | 24 mN/m | 10% | 27 mN/m | 17 |
| II-16 | KF945 | 22 mN/m | 0.025% | 27 mN/m | 12 |
| II-17 | KF945 | 22 mN/m | 10% | 27 mN/m | 17 |
| II-18 | F444 | 32 mN/m | 0.025% | 26 mN/m | 12 |

TABLE 1-continued

| Undercoating liquid | Surfactant type | Surface tension of solution in 1,6-hexanediol diacrylate at a critical micelle concentration | Surfactant content Mass % with respect to total solution | Surface tension of undercoating liquid | Viscosity of undercoating liquid |
|---|---|---|---|---|---|
| II-19 | F444 | 32 mN/m | 10% | 25 mN/m | 17 |
| II-20 | F446 | 29 mN/m | 0.025% | 27 mN/m | 12 |
| II-21 | F446 | 29 mN/m | 10% | 27 mN/m | 17 |
| II-22 | F470 | 25 mN/m | 0.025% | 26 mN/m | 12 |
| II-23 | F470 | 25 mN/m | 10% | 24 mN/m | 17 |
| II-24 | F479 | 22 mN/m | 0.025% | 26 mN/m | 12 |
| II-25 | F479 | 22 mN/m | 10% | 25 mN/m | 17 |

HDODH hexanediol diacrylate
CMC of BYK307 (manufactured by BYK-CHEMIE) was about 0.2% by mass.
Surfactants other than BMY307 CMC did not reach CMC at 0.025%, but exceeded CMC at 10%.
KF354L, KF351, KF414, and KF945 (manufactured by SHIN-ETSU CHEMICAL CO., LTD.).
F444, F446, F470, and F479 (manufactured by DAINIPPON INK AND CHEMICALS, INCORPORATED).

In the present example, the surface tension was measured using a surface tensiometer CBVP-Z (manufactured by KYOWA INTERFACE SCIENCE CO., LTD.), and the viscosity was measured using a lab-use handy type digital viscometer VISCOSTICK (manufactured by MARUYASU INDUSTRIES CO., LTD.).

<Image Recording and Evaluation>

As the image recording apparatus, there was prepared an experimental machine composed of: an inkjet printer section equipped with a transporting mechanism as the transporting device for roll transporting the recording medium by rotating driving rollers, a roll coater as the undercoating liquid applying device for applying the undercoating liquid to the recording medium, an undercoating liquid semi-curing light source as the undercoating liquid curing device for semi-curing the applied undercoating liquid (a plurality of ultrahigh pressure mercury lamps are disposed in parallel with the direction orthogonal to the transporting direction of the recording medium, or the main scanning direction (width direction) during recording on the recording medium), and a head unit as the image recording device (manufactured by TOSHIBA TECH CORPORATION, including four head sets each having a nozzle density of 600 npi and containing two full line heads each having an inkjet frequency of 6.2 KHz, 636 nozzles, a nozzle density of 300 npi (nozzle/inch, hereinafter the same), and a seven-step variable drop size from 6 pl to 42 pl); and a metal halide lamp as the actinic ray radiation device for further curing the undercoating liquid and the recorded image on the recording medium.

Along the transport path for transporting the recording medium, as shown in FIG. 6, from upstream side to downstream side, a roll coater and an undercoating liquid semi-curing light source are disposed in this order, a head unit having yellow, cyan, magenta, and black inkjet heads is disposed together with ultrahigh pressure mercury lamps for semi-curing the inks, which are disposed in the transporting direction side of each inkjet head, in the downstream of the light source in such a manner that the recording medium is movable immediately below the head. The head is composed of yellow, cyan, magenta, and black inkjet heads, which are fixed in the body of the machine in this order from the upstream side of the transporting direction side of the transport path for the recording medium. A metal halide lamp is disposed in the further downstream of the black inkjet head in the transporting direction of the recording medium.

In the present example, the undercoating liquid II-1 was loaded in the experimental machine, and at the same time, the above-described four color inkjet recording liquids I-1 to I-4 were loaded in the inkjet printer section of the machine, and an image was recorded on a recording medium as described below.

In the first place, using the above-described experimental machine, the undercoating liquid was evenly applied with a roll coater in a thickness of 5μm (application speed: 400 mm/s). The applied undercoating liquid was exposed to the undercoating liquid semi-curing light source (light intensity: 500 mW/cm$^2$) to semi-cure the undercoating liquid.

At that time, the portion from the surface to a depth of 1μm of the undercoating liquid on the recording medium was uncured, and the deeper portion was completely cured. The surface portion was scraped up, and the viscosity at 25° C. was measured using a lab-use handy type digital viscometer VISCOSTICK (manufactured by MARUYASU INDUSTRIES CO., LTD.). The viscosity of the surface portion was 1000 mPa·s.

Thereafter, using the heads charged with the inkjet recording liquids I-1 to I-4, each of the inkjet recording liquids I-1 to I-4 independently impinged on the above-described recording medium coated with the undercoating liquid without irradiation with the accompanying ultrahigh pressure mercury lamps for semi-curing the inks, and fixed by irradiation (curing) with UV light at a wavelength of 365 nm emitted from the metal halide lamp at a light intensity of 3000 mW/cm$^2$.

At that time, the monochromatic images printed by independently ejecting each of the inkjet recording liquids I-1 to I-4 were a line printed at 600 dpi in the main scanning direction and 150 dpi in the sub-scanning direction (one drop used, 6 pL ejected), and a full-page inkjet image printed at 600 dpi in the main scanning direction and 600 dpi in the sub-scanning direction (2 drops used, 12 pL ejected).

Further, the head angle with respect to the main scanning direction was changed, and a full-page inkjet image (2 drops used, 12 pL ejected) was made at 600 dpi in the main scanning direction, and 450 dpi in the sub-scanning direction.

Further, the head angle with respect to the main scanning direction was changed, and a full-page inkjet image (2 drops used, 12 pL ejected) was made at 450 dpi in the main scanning direction, and 450 dpi in the sub-scanning direction.

Further, a full-color image of a person (woman) was printed using all colors at 600 dpi in the main scanning direction, and 600 dpi in the sub-operation direction. In this case, each color ink was semi-cured by pinning exposure using the ultrahigh pressure mercury lamps for semi-curing the inks at a light intensity of 500 mW/cm$^3$ (recording medium transporting speed, 400 mm/s; 3-gradation printings from 6 to 12 pL; an antialiasing process was conducted.). Thereafter, the image was radiated with UV light at a wavelength of 365 nm by the metal halide lamp at a light intensity of 3000 mW/cm$^2$ to fix the image.

In the above-described procedure, the interval from the completion of the application of the undercoating liquid to the first ejecting of the yellow inkjet recording liquid I-3 was 0.2 seconds.

LINTEC YUPO 80 (manufactured by LINTEC CORPORATION) was used as the recording medium.

Following the image recording using the undercoating liquid II-1, another images were printed using the above-described undercoating liquids II-2 to II-25 in place of the undercoating liquid II-1.

The images obtained by the above-described procedures were subjected to the following measurements and evaluations. The results of the measurements and evaluations are shown in the following Tables 3 to 6.

-1. Evaluation of Line Width-

The line width of the image drawn on a line was measured with a dot analyzer (trade name: DA6000, manufactured by OJI SCIENTIFIC INSTRUMENTS CO., LTD.). Measured values of the line width (μm) are listed in Tables 2 to 5.

-2. Evaluation of Full-Page Inkjet Image of 600 dpi×600 dpi-

The full-page inkjet images were visually observed, and evaluated on the basis of the following evaluation criteria.

<Evaluation Criteria>

A: No white spot is found all over the page.

B: Few white spots (5μm or smaller) are found.

C: Evident white spots (5μm or larger) are found.

-3. Evaluation of Full-Page Inkjet Image of 600 dpi×450 dpi-

The full-page inkjet images were visually observed, and evaluated on the basis of the following evaluation criteria.

<Evaluation Criteria>

A: No white spot is found all over the page.

B: Few white spots (5μm or smaller) are found.

C: Evident white spots (5μm or larger) are found.

-4. Evaluation of Full-Page Inkjet Image of 450 dpi—450 dpi-

The full-page inkjet images were visually observed, and evaluated on the basis of the following evaluation criteria.

<Evaluation Criteria>

A: No white spot is found all over the page.

B: Few white spots (5 μm or smaller) are found.

C: Evident white spots (5 μm or larger) are found.

-5. Evaluation of Practical Image-

Full-color practical images of a person (woman) were visual observed, and evaluated on the basis of the following evaluation criteria.

<Evaluation Criteria>

A: Distinct, favorable image with a sufficient density.

B: Slightly pale in high-density portions such as hair portion. C: Generally pale in color.

D: Indistinct image.

TABLE 2

<Cyan ink>

| Undercoating liquid | Line width | 600 × 600 dpi Full-page ink ejecting | 600 × 450 dpi Full-page ink ejecting | 450 × 450 dpi Full-page ink ejecting | Remark |
|---|---|---|---|---|---|
| II-1 | 120 μm | A | A | A | Comparative example |
| II-2 | 60 μm | A | A | A | The invention |
| II-3 | 60 μm | A | A | A | The invention |
| II-4 | 60 μm | A | A | B | The invention |
| II-5 | 60 μm | A | B | B | The invention |
| II-6 | 60 μm | B | B | C | Comparative example |
| II-7 | 60 μm | B | B | C | Comparative example |
| II-8 | 60 μm | B | B | C | Comparative example |
| II-9 | 60 μm | B | C | C | Comparative example |
| II-10 | 180 μm | A | A | A | Comparative example |
| II-11 | 180 μm | A | A | A | Comparative example |
| II-12 | 140 μm | A | A | A | Comparative example |
| II-13 | 140 μm | A | A | A | Comparative example |
| II-14 | 60 μm | A | A | A | The invention |
| II-15 | 60 μm | B | C | C | Comparative example |
| II-16 | 60 μm | A | A | A | The invention |
| II-17 | 60 μm | B | C | C | Comparative example |
| II-18 | 180 μm | A | A | A | Comparative example |
| II-19 | 180 μm | A | A | A | Comparative example |
| II-20 | 150 μm | A | A | A | Comparative example |
| II-21 | 150 μm | A | A | A | Comparative example |
| II-22 | 60 μm | A | A | A | The invention |
| II-23 | 60 μm | B | C | C | Comparative example |
| II-24 | 60 μm | A | A | A | The invention |
| II-25 | 60 μm | B | C | C | Comparative example |

TABLE 3

<Magenta ink>

| Undercoating liquid | Line width | 600 × 600 dpi Full-page ink ejecting | 600 × 450 dpi Full-page ink ejecting | 450 × 450 dpi Full-page ink ejecting | Remark |
|---|---|---|---|---|---|
| II-1 | 120 μm | A | A | A | Comparative example |
| II-2 | 60 μm | A | A | A | The invention |
| II-3 | 60 μm | A | A | A | The invention |
| II-4 | 60 μm | A | A | B | The invention |
| II-5 | 60 μm | A | B | B | The invention |
| II-6 | 60 μm | B | B | C | Comparative example |
| II-7 | 60 μm | B | B | C | Comparative example |
| II-8 | 60 μm | B | B | C | Comparative example |
| II-9 | 60 μm | B | C | C | Comparative example |
| II-10 | 180 μm | A | A | A | Comparative example |
| II-11 | 180 μm | A | A | A | Comparative example |
| II-12 | 140 μm | A | A | A | Comparative example |
| II-13 | 140 μm | A | A | A | Comparative example |
| II-14 | 60 μm | A | A | A | The invention |
| II-15 | 60 μm | B | C | C | Comparative example |
| II-16 | 60 μm | A | A | A | The invention |
| II-17 | 60 μm | B | C | C | Comparative example |
| II-18 | 180 μm | A | A | A | Comparative example |
| II-19 | 180 μm | A | A | A | Comparative example |
| II-20 | 150 μm | A | A | A | Comparative example |
| II-21 | 150 μm | A | A | A | Comparative example |
| II-22 | 60 μm | A | A | A | The invention |
| II-23 | 60 μm | B | C | C | Comparative example |
| II-24 | 60 μm | A | A | A | The invention |
| II-25 | 60 μm | B | C | C | Comparative example |

TABLE 4

<Yellow ink>

| Undercoating liquid | Line width | 600 × 600 dpi Full-page ink ejecting | 600 × 450 dpi Full-page ink ejecting | 450 × 450 dpi Full-page ink ejecting | Remark |
|---|---|---|---|---|---|
| II-1 | 120 μm | A | A | A | Comparative example |
| II-2 | 60 μm | A | A | A | The invention |
| II-3 | 60 μm | A | A | A | The invention |
| II-4 | 60 μm | A | A | B | The invention |
| II-5 | 60 μm | A | B | B | The invention |
| II-6 | 60 μm | B | B | C | Comparative example |
| II-7 | 60 μm | B | B | C | Comparative example |
| II-8 | 60 μm | B | B | C | Comparative example |
| II-9 | 60 μm | B | C | C | Comparative example |
| II-10 | 180 μm | A | A | A | Comparative example |
| II-11 | 180 μm | A | A | A | Comparative example |
| II-12 | 140 μm | A | A | A | Comparative example |
| II-13 | 140 μm | A | A | A | Comparative example |
| II-14 | 60 μm | A | A | A | The invention |
| II-15 | 60 μm | B | C | C | Comparative example |
| II-16 | 60 μm | A | A | A | The invention |
| II-17 | 60 μm | B | C | C | Comparative example |
| II-18 | 180 μm | A | A | A | Comparative example |
| II-19 | 180 μm | A | A | A | Comparative example |
| II-20 | 150 μm | A | A | A | Comparative example |
| II-21 | 150 μm | A | A | A | Comparative example |
| II-22 | 60 μm | A | A | A | The invention |
| II-23 | 60 μm | B | C | C | Comparative example |
| II-24 | 60 μm | A | A | A | The invention |
| II-25 | 60 μm | B | C | C | Comparative example |

TABLE 5

| <Black ink> | | | | | |
|---|---|---|---|---|---|
| Undercoating liquid | Line width | 600 × 600 dpi Full-page ink ejecting | 600 × 450 dpi Full-page ink ejecting | 450 × 450 dpi Full-page ink ejecting | Remark |
| II-1 | 120 μm | A | A | A | Comparative example |
| II-2 | 60 μm | A | A | A | The invention |
| II-3 | 60 μm | A | A | A | The invention |
| II-4 | 60 μm | A | A | B | The invention |
| II-5 | 60 μm | A | B | B | The invention |
| II-6 | 60 μm | B | B | C | Comparative example |
| II-7 | 60 μm | B | B | C | Comparative example |
| II-8 | 60 μm | B | B | C | Comparative example |
| II-9 | 60 μm | B | C | C | Comparative example |
| II-10 | 180 μm | A | A | A | Comparative example |
| II-11 | 180 μm | A | A | A | Comparative example |
| II-12 | 140 μm | A | A | A | Comparative example |
| II-13 | 140 μm | A | A | A | Comparative example |
| II-14 | 60 μm | A | A | A | The invention |
| II-15 | 60 μm | B | C | C | Comparative example |
| II-16 | 60 μm | A | A | A | The invention |
| II-17 | 60 μm | B | C | C | Comparative example |
| II-18 | 180 μm | A | A | A | Comparative example |
| II-19 | 180 μm | A | A | A | Comparative example |
| II-20 | 150 μm | A | A | A | Comparative example |
| II-21 | 150 μm | A | A | A | Comparative example |
| II-22 | 60 μm | A | A | A | The invention |
| II-23 | 60 μm | B | C | C | Comparative example |
| II-24 | 60 μm | A | A | A | The invention |
| II-25 | 60 μm | B | C | C | Comparative example |

TABLE 6

| <Actual Assessment Printed Image> | | |
|---|---|---|
| Undercoating liquid | Actual Assessment Printed Image | Remark |
| II-1 | A | Comparative example |
| II-2 | A | The invention |
| II-3 | A | The invention |
| II-4 | A | The invention |
| II-5 | A | The invention |
| II-6 | B | Comparative example |
| II-7 | B | Comparative example |
| II-8 | B | Comparative example |
| II-9 | B | Comparative example |
| II-10 | D | Comparative example |
| II-11 | D | Comparative example |
| II-12 | D | Comparative example |
| II-13 | D | Comparative example |
| II-14 | A | The invention |
| II-15 | B | Comparative example |
| II-16 | A | The invention |
| II-17 | B | Comparative example |
| II-18 | D | Comparative example |
| II-19 | D | Comparative example |
| II-20 | D | Comparative example |
| II-21 | D | Comparative example |

TABLE 6-continued

| <Actual Assessment Printed Image> | | |
|---|---|---|
| Undercoating liquid | Actual Assessment Printed Image | Remark |
| II-22 | A | The invention |
| II-23 | B | Comparative example |
| II-24 | A | The invention |
| II-25 | B | Comparative example |

Tables 2 to 6 indicate that favorable thin line imaging characteristics were achieved through the use of the surfactant according to the invention. Further, the effect of the surfactant was confirmed even with a very little content of 0.025% by mass with respect to the total weight of the undercoating liquid, which indicates that the surfactant exerts its effect even when the surfactant is used in very minute amounts.

On the other hand, the thin line imaging characteristics were not achieved in the comparative example in which a surfactant other than the surfactant according to the invention was used. Further, when the surfactant according to the invention was used in an amount outside the range according to the invention, it was found that the adjacent impinged droplets did not connect, and the density was insufficient in the full-page ink ejecting for achieving a high density.

Example 2

The content of the initiator in the cyan ink solution (I-1), magenta ink solution (I-2), yellow ink solution (I-3), and the undercoating liquid (II-2) of Example 1 was adjusted to prepare ink solutions and an undercoating liquid which achieve the curing sensitivity ratio Sc/Su listed in the following table, wherein Sc is the curing sensitivity of each ink solution, and Su is the curing sensitivity of the undercoating liquid. The increase or decrease in the amount of the initiator was compensated by increasing or decreasing the amount of dipropyleneglycol diacrylate.

After the undercoating liquid was cured to the same degree of the curing state of Example 1, using the experimental machine used in Example 1, a portion having no ink droplet and a 1-mm line formed by ejecting two drops of for each of yellow ink, magenta ink, and cyan ink in this order were formed alternately, and a black dot image (150 dpi×50 dpi, 1 drop) was superposed thereon to form an image. After the ejection of each color ink, the color inks were light-exposed to cure in the same state as Example 1.

On the sample prepared above, the dot diameter of the black ink on the portion subjected to no ink ejecting (du) and the dot diameter on the portion subjected to three-color ink ejecting (dc) were measured. The measured values of the dc/du are listed in the following table.

TABLE 7

| Sc/Su | dc/du |
|---|---|
| 5 | 0.7 |
| 2 | 1.0 |
| 1 | 1.0 |
| 1/2 | 1.1 |
| 1/5 | 1.3 |

Although blurring is suppressed by the method described in Japanese Patent Application Laid-Open (JP-A) No. 2004-42548, there is still a problem that the formed image may vary with recording media. Therefore, the method is insufficient to solve the problems such as uneven line width or color unevenness due to mixture of droplets. The methods described in JP-A No. 2003-145745, and JP-A No. 2004-42525, are also insufficient to solve the problems such as uneven line width or color unevenness due to mixture of droplets. In addition, the method described in JP-A No. 2005-96254, also cannot solve the problems such as uneven line width or color unevenness due to mixture of droplets.

On the other hand, in the case where an image is recorded with a low resolution head unit, if the amount of ejected ink is small or the density of the ink ejected for recording is low, the ink droplets (dots) spread disorderly to cause image disturbance or blurring, or the dots insufficiently spread, which causes problems such as white spots, reduction in image density, and image blurring or unevenness.

The invention has been accomplished in view of the above-described problems, and is intended to attain an object of providing an inkjet recording method and an inkjet recording apparatus which provide excellent image uniformity without varying with recording media, independent of the type of recording media, suppress the occurrence of ink bleeding and uneven line width or color unevenness caused by coalescence between droplets, in addition, maintain a uniform dot diameter, and allow recording with a high density and good reproducibility in image details regardless of the image form.

According to the invention, there are provided an inkjet recording method and an inkjet recording apparatus which provide excellent image uniformity among different recording media independent of the type of recording media, suppress the occurrence of ink bleeding and uneven line width or color unevenness caused by coalescence between droplets, in addition, maintain a uniform dot diameter when recording an image region (for example, an image having a low resolution or density) having a low dot density with a small amount of liquid, and allow recording with a high density and good reproducibility in image details independent of the image form.

Therefore, a high quality image on which ink droplets are connected to each other all over the page is produced with a high density and reproducibility with clarity even when a low-cost, low resolution head unit is used.

All publications, patent applications, and technical standards mentioned in this specification are herein incorporated by reference to the same extent as if each individual publication, patent application, or technical standard was specifically and individually indicated to be incorporated by reference.

What is claimed is:

1. An inkjet recording method comprising:

applying an undercoating liquid onto a recording medium, the undercoating liquid containing at least one surfactant in an amount of from 0.001% by mass to a critical micelle concentration, the surfactant imparting a surface tension of 25 mN/m or less when the surfactant is dissolved in 1,6-hexanediol diacrylate at the critical micelle concentration;

semi-curing the undercoating liquid; and recording an image by ejecting an ink onto the semi-cured undercoating liquid, the ink being curable by irradiation with a first actinic ray.

2. The inkjet recording method of claim 1, wherein the content of the surfactant is no more than ½ of the critical micelle concentration.

3. The inkjet recording method of claim 1, wherein the undercoating liquid is semi-cured by irradiation with a second actinic ray.

4. The inkjet recording method of claim 3, wherein the amount of the energy of the second actinic ray is from 1 to 500 $mJ/cm^2$.

5. The inkjet recording method of claim 1, wherein the undercoating liquid is semi-cured by heating.

6. The inkjet recording method of claim 5, wherein the semi-curing of the undercoating liquid by heating is performed by heating for 0.1 to 1 seconds under conditions such that the surface temperature of the recording medium is in the range of from 40 to 80° C.

7. The inkjet recording method of claim 1, wherein the undercoating liquid is semi-cured by irradiation with UV light.

8. The inkjet recording method of claim 1, wherein the undercoating liquid further contains a radical polymerizable composition.

9. The inkjet recording method of claim 1, wherein a ratio, per area, of the amount of the undercoating liquid applied to the amount of ink droplets is in the range of from 0.05 to 5.

10. The inkjet recording method of claim 1, wherein an interval between the applying of the undercoating liquid to ejecting ink droplets is from 5 microseconds to 10 seconds.

11. The inkjet recording method of claim 1, wherein the image recording comprises recording using an ink set containing multiple color inks, and semi-curing at least one of the color inks that are ejected.

12. The inkjet recording method of claim 11, wherein the semi-curing comprises semi-curing each of the ejected color inks.

13. The inkjet recording method of claim 1, further comprising further enhancement of curing of the undercoating liquid and the ejected ink.

14. The inkjet recording method of claim 13, wherein the further enhancement of curing of the undercoating liquid and the ejected ink comprises applying energy.

15. The inkjet recording method of claim 1, wherein the curing sensitivity of the ink is equivalent to or higher than a curing sensitivity of the undercoating liquid.

16. An inkjet recording apparatus comprising:

an undercoating liquid application device for applying an undercoating liquid on a recording medium, the undercoating liquid containing at least one surfactant in an amount of from 0.001% by mass to a critical micelle concentration, the surfactant achieving a surface tension of 25 mN/m or lower when dissolved in 1,6-hexanediol diacrylate at the critical micelle concentration;

an undercoating liquid curing device for semi-curing the undercoating liquid by applying energy to at least a portion of the undercoating liquid, the undercoating liquid curing device being disposed downstream of the undercoating liquid application device in a traveling direction of the recording medium; and an image recording device for recording an image by ejecting an ink onto the semi-cured undercoating liquid, the ink being curable by irradiation with an actinic ray, and the image recording device being disposed downstream of the undercoating liquid curing device in the traveling direction of the recording medium.

17. The inkjet recording apparatus of claim 16, further comprising a device for transporting the recording medium, and a device for radiating an actinic ray, the device for radiating an actinic ray being disposed downstream of the image recording device in a conveyance direction of the recording medium to be conveyed, and radiating an actinic ray to the recording medium having an image recorded thereon by the image recording device to further accelerate curing of the undercoating liquid and the ejected ink, wherein the image recording device ejects the ink using at least one line type inkjet head which is disposed in parallel with a direction orthogonal to the conveyance direction of the recording medium, and has a length corresponding to the entire width of a recordable portion of the recording medium.

* * * * *